United States Patent [19]

Kishimoto

[11] Patent Number: 4,752,556

[45] Date of Patent: Jun. 21, 1988

[54] METHOD FOR PROCESSING OF SILVER HALIDE COLOR PHOTO GRAPHIC MATERIALS

[75] Inventor: Shinzo Kishimoto, Minami-Ashigara, Japan

[73] Assignee: Fuji Photo Film Co., Ltd., Minami-Ashigara, Japan

[21] Appl. No.: 31,189

[22] Filed: Mar. 27, 1987

Related U.S. Application Data

[63] Continuation of Ser. No. 770,213, Aug. 28, 1985, abandoned.

[30] Foreign Application Priority Data

Aug. 31, 1984 [JP] Japan ..... 59-182461

[51] Int. Cl.[4] ..... G03C 7/40; G03C 5/24; G03C 11/00

[52] U.S. Cl. ..... 430/398; 430/372; 430/421; 430/463

[58] Field of Search ..... 430/372, 398, 421, 463

[56] References Cited

U.S. PATENT DOCUMENTS

| | | | |
|---|---|---|---|
| 4,336,324 | 6/1982 | Koboshi et al. | 430/372 |
| 4,491,630 | 1/1985 | Ishikawa et al. | 430/372 |
| 4,585,728 | 4/1986 | Furutachi et al. | 430/372 |

*Primary Examiner*—Mukund J. Shah

*Attorney, Agent, or Firm*—Burns, Doane, Swecker & Mathis

[57] ABSTRACT

A method for processing of a silver halide color photographic material for photography, which comprises a fixing or bleach-fixing step, followed by a water washing or stabilizing step, characterized in that:

(i) said water washing or stabilizing step comprises multistage countercurrent baths which are countercurrently replenished with a washing water or stabilizing solution, (ii) the amount of the replenishing material is 3 to 50 times the volume of the solution taken by the photographic material into said water washing or stabilizing bath from the preceding bath and, (iii) said photographic material comprises at least one 2-equivalent magenta coupler represented by the formula (I):

(I)

wherein $R_1$ represents hydrogen atom or a substituent, X represents a split-off group, Za, Zb and Zc represent individually methine, substituted methine, =N— or —NH—, one of the Za-Zb and Zb-Zc linkages is a double bond and the other is a single bond, or the formula (II):

(II)

wherein $R_1$ represents a carbonamido, anilino or ureido group, $R_2$ represents a phenyl group and X represents a split-off group. This process provides a color image having good storage property and reduces the amount of waste liquid.

65 Claims, No Drawings

METHOD FOR PROCESSING OF SILVER HALIDE COLOR PHOTO GRAPHIC MATERIALS

This application is a continuation of application Ser. No. 770,213, filed Aug. 28, 1985, now abandoned.

BACKGROUND OF THE INVENTION (1) Field of the Invention

This invention relates to a method for processing of silver halide color photographic materials for photography and more particularly, to an improved photographic process which provides a color image having improved stability.

(2) Description of the Prior Art

A silver halide color photographic material for photography is imagewise exposed, followed by color development wherein a dye-forming coupler reacts with the oxidation products of an aromatic primary amine developing agent to form a color image. This method usually comprises a subtractive color processes wherein blue, green and red colors are reproduced by the formation of complementary color images, i.e. yellow, magenta and cyan color images, respectively.

In a color photographic process, a color dye-forming coupler is incorporated in a light-sensitive photographic emulsion layer or a different, color image-forming layer and reacts with the oxidation products of a color developing agent formed upon development to produce a non-diffusible dye.

A color photographic image can generally be formed by imagewise exposing a silver halide color photographic material for photography, color developing the exposed material with a color developer comprising an aromatic primary amine developing agent such as paraphenylenediamine, and subsequently bleaching, fixing, water washing and/or stabilizing the developed material. In a color reversal process, a first development, water washing and reversal processing are done prior to a color development.

Recently, in automatic and continuous development processes for color photographic materials, preservation of the environment and conservation and recovery of silver resources have become major concerns and for these purposes, various methods are now being studied. These methods include, for example, methods for prevention of environmental pollution, for effective recovery of silver, for reduction of the amount of required washing water or stabilizing solution, and for reuse of washing water and stabilizing solution.

For example, a multistage countercurrent system has been proposed wherein two or more baths for water washing or stabilizing are provided and washing water or the stabilizing solution is replenished countercurrently so as to substantially reduce the amount of the replenishing material used. This system makes it possible to significantly reduce the amount of waste liquid and enviromental pollution as well as to decrease the amount of water used and to reuse the water.

Japanese Patent Application (OPI) (unexamined published application) No. 57-8543 discloses a process for stabilizing a photographic material after it is fixed, wherein the fixed material is processed through two or more stabilizing baths to which the stabilizing solution is replenished countercurrently. The amount of the stabilizing solution replenished in this process is relatively small and it is 3 to 50 times the volume of stabilizing solution taken into the bath from the preceding one, which substantially decreases the amount of water used in this process, and therefore it is very advantageous from the viewpoint of environmental preservation and water conservation, which are now of great concern.

However, when a color photographic material for photography is processed by this process wherein the multistage countercurrent system is used to reduce the volume of washing water or stabilizing solution, the resulting photographic material is extremely low in stability of color images, among which the stability of the magenta color image is particularly bad.

SUMMARY OF THE INVENTION

An object of this invention is therefore to provide a method for processing a silver halide color photographic material for photography wherein the photographic material which has been fixed or bleach fixed is water washed or stabilized through two or more processing baths to which a small amount of washing water or stabilizing solution is replenished, to give color images having good stability, particularly to magenta color image having improved stability.

Another object of this invention is to provide a method for processing a silver halide color photographic material for photography which makes it possible to substantially reduce the amount of washing water or stabilizing solution.

The above-mentioned objects can be accomplished by a method for processing of a silver halide color photographic material for photography, which comprises a fixing or bleach-fixing step, followed by a water washing or stabilizing step, characterized in that:

(i) said water washing or stabilizing step comprises multistage countercurrent baths which are countercurrently replenished with a washing water or stabilizing solution, (ii) the amount of the replenishing material is 3 to 50 times the volume of the solution taken by the photographic material into said water washing or stabilizing bath from the preceding bath, and (iii) said photographic material comprises at least one 2-equivalent magenta coupler selected from couplers (I-a), (I-b), (II-a) and (II-b), wherein: said coupler (I-a) is represented by the formula (I):

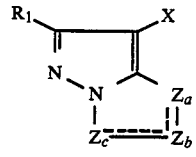

(I)

wherein $R_1$ represents a hydrogen atom or a substituent, X represents a group which can be split off by a coupling reaction with the oxidation products of an aromatic primary amine developing agent, Za, Zb and Zc represent individually methine, substituted methine, =N— or —NH—, one of the Za-Zb and Zb-Zc linkages is a double bond and the other is a single bond, the Zb-Zc linkage, if it represents carbon-carbon double bond, may be a part of an aromatic ring, said coupler (I-b) comprise two or more residues which are obtained by removing $R_1$, X, or a substituent on substituted methine Za, Zb or Zc from the formula (I) and which are linked to each other through a linkage group or attached to a main chain of a polymer, said coupler (II-a) is represented by the formula (II):

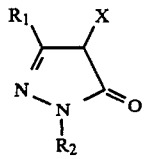

(II)

wherein $R_1$ represents a carbonamido, anilino or ureido group, $R_2$ represents a phenyl group and X represents a group which can be split off by a coupling reaction with the oxidation products of an aromatic primary amine developing agent, and said coupler (II-b) comprises two or more residues which are obtained by removing $R_1$, $R_2$ or X from the formula (II) and which are linked to each other through a linkage group or attached to a main chain of a polymer.

Generally, there is almost no difference in color image stability between a color photographic material for photography comprising a four-equivalent magenta dye-forming coupler and one comprising a two-equivalent magenta dye-forming coupler when they are processed by a conventional process comprising usual water washing or stabilizing processing. However, the magenta color image of the photographic material comprising the four-equivalent magenta coupler is very low in stability when, after being fixed or bleach-fixed, the material is water washed or stabilized through a multistage countercurrent process wherein a small amount of replenishing material is used. It is therefore unexpected that the magenta color image of the photographic material for photography comprising the two-equivalent magenta coupler is improved to such a level that is raises no problem from the practical point of view even when the photographic material is processed through the multistage countercurrent process using a small amount of replenishing material.

DETAILED DESCRIPTION OF THE INVENTION

The coupler (I-a) represented by the formula (I) will now be explained in detail.

In the formula, (I), $R_1$ represents hydrogen or a substituent and X represents a group which can be split off upon the coupling reaction with the oxidation products of an aromatic primary amine developing agent. Za, Zb and Zc represent individually methine, substituted methine, =N— or —NH—, one of the Za-Zb and Zb-Zc linkages is a double bond and the other is a single bond. When the Zb-Zc is a carbon-carbon double bond, it may be a part of an aromatic ring.

The coupler (I-b) comprises two or more residues which are obtained by removing $R_1$, X or a substituent on substituted methine Za, Zb or Zc from the formula (I) and which are linked to each other through a linkage group or attached to a main chain of a polymer.

Such couplers include bis type compounds and polymer couplers. The polymer couplers may be a homopolymer of a monomer (preferably, a vinyl-containing monomer, hereinafter referred to as vinyl monomer) having the residue of the formula (I) or a copolymer of the monomer and an ethylenic monomer which does not form any color compound and which does not couple with the oxidation products of an aromatic primary amine developing agent.

The compounds represented by the formula (I) are nitrogen-containing 5-membered ring-5-membered ring condensed heterocyclic couplers, the color forming nuclei of which show an aromaticity which is electronically similar to that of naphthalene and they have chemical structures generally called azapentalene. Preferred couplers represented by the formula (I) include 1H-imidazo[1,2-b]pyrazoles, 1H-pyrazolo[1,5-b]pyrazoles, 1H-pyrazolo[5,1-c][1,2,4]triazoles, 1H-pyrazolo[1,5-b][1,2,4]triazoles, 1H-pyrazolo[1,5-d]tetrazoles and 1H-pyrazolo[1,5-a]benzimidazoles which are represented by the formulas (I)-2, (I)-3, (I)-4, (I)-5, (I)-6 and (I)-7, respectively. Of these, the compounds represented by the formulas (I)-2, (I)-4 and (I)-5 are preferred and (I)-5 is particularly preferred.

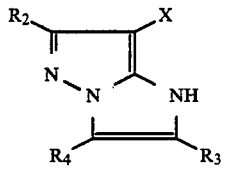

[I]-2

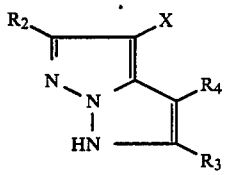

[I]-3

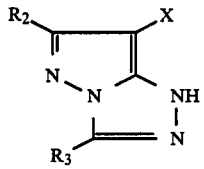

[I]-4

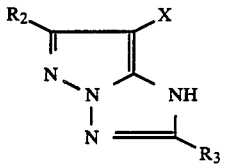

[I]-5

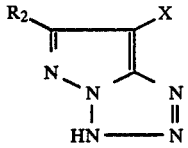

[I]-6

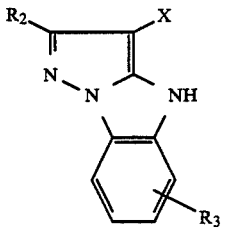

[I]-7

In the formulas (I)-2 to (I)-7, $R_2$, $R_3$ and $R_4$ represent individually hydrogen or halogen atom, alkyl, aryl, heteroring, cyano, alkoxy, aryloxy, heteroring-oxy, acyloxy, carbamoyloxy, silyloxy, sulfonyloxy, acylamino, anilino, ureido, imido, sulfamoylamino, carbamoylamino, alkylthio, arylthio, heteroring-thio, alkoxycarbonylamino, aryloxycarbonylamino, sulfonamido, carbamoyl, acyl, sulfamoyl, sulfonyl, sulfinyl, alkoxycarbonyl or aryloxycarbonyl group and X represents halogen atom, carboxy group or a coupling split-off group which is attached to carbon atom at the coupling position through oxygen, nitrogen or sulfur atom.

The magenta couplers which can be used in this invention may also include bis-type compounds which comprises two residues which are obtained by removing $R_2$, $R_3$, $R_4$ or X from the formulas (I)-2 to (I)-7 and which are linked to each other through a bivalent group. The magenta couplers which can be used in this invention may also include polymer couplers which comprise vinyl monomeric groups to which the residues obtained by removing $R_2$, $R_3$, or $R_4$ from the formulas (I)-2 to (I)-7 are linked through only a single bond or a linkage group.

More specifically, $R_2$, $R_3$ and $R_4$ represent hydrogen or halogen atom (e.g. chlorine, bromine, etc.), alkyl (e.g. methyl, propyl, t-butyl, trifluoromethyl, tridecyl, 3-(2,4-di-t-amylphenoxy) propyl, 2-dodecyloxyethyl, 3-phenoxypropyl, 2-hexylsulfonylethyl, cyclopentyl, benzyl, etc.), aryl (e.g. phenyl, 4-t-butylphenyl, 2,4-di-t-amylphenyl, 4-tetradecaneamidophenyl, etc.), heteroring (e.g. 2-furyl, 2-thienyl, 2-pyrimidinyl, 2-benzothiazolyl, etc.), cyano, alkoxy (e.g., methoxy, ethoxy, 2-methoxyethoxy, 2-dodecyloxyethoxy, 2-methanesulfonylethoxy, etc.), aryloxy (e.g., phenoxy, 2-methylphenoxy, 4-t-butylphenoxy, etc.), heteroring-oxy (e.g. 2-benzimidazolyloxy, etc.), acyloxy (e.g., acetoxy, hexadecanoyloxy, etc.), carbamoyloxy (e.g., N-phenylcarbamoyloxy, N-ethylcarbamoyloxy, etc.), silyloxy (e.g., trimethylsilyloxy, etc.), sulfonyloxy (e.g., dodecylsulfonyloxy, etc.), acylamino (e.g., acetamido, benzamido, tetradecaneamido, alpha-(2,4-di-t-amylphenoxy)-butylamido, gamma-(3-t-butyl-4-hydroxyphenoxy)-butylamido, alpha-{4-(4-hydroxyphenylsulfonyl)-phenoxy}decaneamido, etc.), anilino (e.g., phenylamino, 2-chloroanilino, 2-chloro-5-tetradecaneamidoanilino, 2-chloro-5-dodecyloxycarbonylanilino, N-acetylanilino, 2-chloro-5-{alpha(3-t-butyl-4-hydroxyphenoxy)dodecaneamido}anilino, etc.), ureido (e.g., phenylureido, methylureido, N,N-dibutylureido, etc.), imido (e.g., N-succinimido, 3-benzylhydantoinyl, 4-(2-ethylhexanoylamino)phthalimido, etc.), sulfamoylamino (e.g., N,N-dipropylsulfamoylamino, N-methyl-N-decylsulfamoylamino, etc.), alkylthio (e.g., methylthio, octylthio, tetradecylthio, 2-phenoxyethylthio, 3-phenoxypropylthio, 3-(4-t-butylphenoxy)propylthio, etc.), arylthio, (e.g., phenylthio, 2-butoxy-5-t-octylphenylthio, 3-pentadecylphenylthio, 2-carboxyphenylthio, 4-tetradecaneamidophenylthio, etc.), heteroring-thio (e.g. 2-benzothiazolylthio, etc.), alkoxycabonylamino (e.g., methoxycarbonylamino, tetradecyloxycarbonylamino, etc.), aryloxycarbonylamino (e.g., phenoxycarbonylamino, 2,4-di-t-butylphenoxycarbonylamino, etc.), sulfonamido (e.g., methanesulfonamido, hexadecanesulfonamido, benzenesulfonamido, p-toluenesulfonamido, octadecanesulfonamido, 2-methyloxy-5-t-butylbenzenesulfonamido, etc.), carbamoyl (e.g., N-ethylcarbamoyl, N,N-dibutylcarbamoyl, N-(2-dodecyloxyethyl)carbamoyl, N-methyl-N-dodecylcarbamoyl, N-{3-(2,4-di-t-amylphenoxy)-propyl}carbamoyl, etc.), acyl (e.g., acetyl, (2,4-di-t-amylphenoxy)acetyl, benzoyl, etc.), sulfamoyl (e.g. N-ethylsulfamoyl, N,N-dipropylsulfamoyl, N-(2-dodecyloxyethyl)sulfamoyl, N-ethyl-N-dodecylsulfamoyl, N,N-diethylsulfamoyl, etc.), sulfonyl (e.g., methanesulfonyl, octanesulfonyl, benzenesulfonyl, toluenesulfonyl, etc.), sulfinyl (e.g., octanesulfinyl, dodecylsulfinyl, phenylsulfinyl, etc.), alkoxycarbonyl (e.g., methoxycarbonyl, butyloxycarbonyl, dodecylcarbonyl, octadecylcarbonyl, etc.) or aryloxycarbonyl group (e.g., phenyloxycarbonyl, 3-pentadecyloxycarbonyl, etc.), X represents hydrogen or halogen atom (e.g., chlorine, bromine, iodine, etc.), carboxyl group, an oxygen atom linkage group (e.g., acetoxy, propanoyloxy, benzoyloxy, 2,4-dichlorobenzoyloxy, ethoxyoxaloyloxy, pyruvinyloxy, cinnamoyloxy, phenoxy, 4-cyanophenoxy, 4-methanesulfonamidophenoxy, 4-methanesulfonylphenoxy, alphanaphthoxy, 3-pentadecylphenoxy, benzyloxycarbonyloxy, ethoxy, 2-cyanoethoxy, benzyloxy, 2-phenethyloxy, 2-phenoxyethoxy, 5-phenyltetrazolyloxy, 2-benzothiazolyloxy, etc.), a nitrogen atom linkage group (e.g., benzenesulfonamido, N-ethyltoluenesulfonamido, heptafluorobutaneamido, 2,3,4,5,6-pentafluorobenzamido, octanesulfonamido, p-cyanophenylureido, N,N-diethylsulfamoylamino, 1-piperidyl, 5,5-dimethyl-2,4-dioxo-3-oxazolidinyl, 1-benzyl-ethoxy-3-hydantoinyl, 1,1-dioxo-3(2H)-oxo-2-benzoisothiazolyl, 2-oxo-1,2-dihydro-1-pyridinyl, imidazolyl, pyrazolyl, 3,5-diethyl-1,2,4-triazole-1-yl, 5- or 6-bromo-benzotriazole-1-yl, 5-methyl-1,2,3,4-triazole-1-yl, benzimidazolyl, 3-benzyl-1-hydantoinyl, 1-benzyl-5-hexadecyloxy-3-hydantoinyl, 5-methyl-1-tetrazolyl, 4-methoxyphenylazo, 4-pivaloylaminophenylazo, 2-hydroxy-4-propanoylphenylazo, etc.), or a sulfur atom linkage group (e.g., phenylthio, 2-carboxyphenylthio, 2-methoxy-5-t-octylphenylthio, 4-methanesulfonylphenylthio, 4-octanesulfonamidophenylthio, 2-butoxyphenylthio, 2-(2-hexanesulfonylethyl)-5-t-octylphenylthio, benzylthio, 2-cyanoethylthio, 1-ethoxycarbonyltridecylthio, 5-phenyl-2,3,4,5-tetrazolylthio, 2-benzothiazolylthio, 2-dodecylthio-5-thiophenylthio, 2-phenyl-3-dodecyl-1,2,4-triazolyl-5-thio, etc.).

The bivalent groups to which the residues obtained by removing $R_2$, $R_3$, $R_4$ or X from the formulas (I)-2 to (I)-7 are linked to form a bis-type compound include substituted or unsubstituted alkylene (e.g., methylene, ethylene, 1,10-decylene, —$CH_2CH_2$—O—$CH_2CH_2$—, etc.), substituted or unsubstituted phenylene (e.g., 1,4-phenylene, 1,3-phenylene,

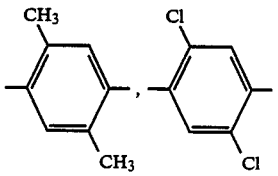

etc.) and —NHCO—R—CONH— wherein R represents substituted or unsubstituted alkylene or phenylene.

The linkage groups through which a vinyl monomer is linked to the residues obtained by removing $R_2$, $R_3$, or $R_4$ from the formula (I)-2 to (I-7) include alkylene (substituted or unsubstituted, e.g., methylene, ethylene, 1,10-decylene, —$CH_2CH_2OCH_2CH_2$—, etc.), phenylene (substituted or unsubstituted, e.g., 1,4-phenylene, 1,3-phenylene,

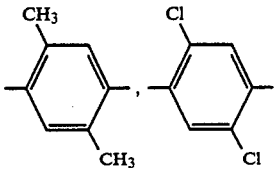

etc.), —NHCO—, —CONH—, —O—, —OCO—, aralkylene (e.g.,

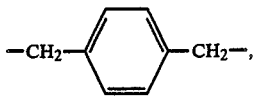

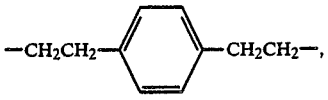

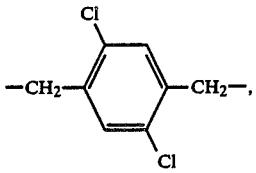

etc.) and combinations thereof.

The vinyl monomers which constitute the magenta polymer coupler which can be used in this invention may be substituted with one or more substituents such as hydrogen or chlorine atom, a lower alkyl group having 1 to 4 carbon atoms at positions other than that occupied by the residue derived from the formulas (I)-2 to (I)-7.

Examples of ethylenic monomers which do not couple with the oxidation products of an aromatic primary amine developing agent and which do not form any color compounds include acrylic acid, alpha-chloroacrylic acid, alpha-alkylacrylic acid (e.g., methacrylic acid), esters or amides derived from these acrylic acids (e.g., acrylamide, n-butylacrylamide, t-butylacrylamide, diacetoneacrylamide, methacrylamide, methyl acrylate, ethyl acrylate, n-propyl acrylate, n-butyl acrylate, t-butyl acrylate, iso-butyl acrylate, 2-ethylhexyl acrylate, n-octyl acrylate, lauryl acrylate, methyl methacrylate, ethyl methacrylate, n-butyl methacrylate and beta-hydroxy methacrylate), methylene bisacrylamide, vinyl esters (e.g., vinyl acetate, vinyl propionate and vinyl laurate), acrylonitrile, methacrylonitrile, aromatic vinyl compounds (e.g., styrene and derivatives thereof, vinyltoluene, divinylbenzene, vinyl acetophenone and sulfostyrene), itaconic acid, citraconic acid, crotonic acid, vinylidene chloride, vinylalkylether (e.g., vinylethylether), maleic acid, maleic anhydride, maleic acid esters, N-vinyl-2-pyrrolidone, and 2- and 4-vinyl pyridine. Two or more ethylenic monomers may be used in combination.

Examples of the compounds represented by the formulas (I)-2 to (I)-7 and methods for the synthesis thereof are described in the following literature references.

The compounds of the formula (I)-2 are described in U.S. Pat. No. 4,500,630, etc., those of the formula (I)-3 in Japanese Patent Application (OPI) No. 60-43659, etc., those of the formula (I)-4 in Japanese Patent Publication No. 47-27411, etc., those of the formula (I)-5 in Japanese Patent Application (OPI) No. 59-171956 (EP 0119860), and Japanese Patent Application No. 59-27745, etc., those of the formula (I)-6 in Japanese Patent Application (OPI) No. 60-33552, etc., and those of the formula (I)-7 in U.S. Pat. No. 3,061,432, etc.

Ballast groups which are high in coupling activity and which are described in Japanese Patent Applicaiton (OPI) No. 58-42045 and Japanese Patent Application (OPI) Nos. 59-214854 (EP 126433A), 59-177553, 59-177554 and 59-177557, etc. may be applied to any of the compounds represented by the formulas (I)-2 to (I)-7.

Specific examples of the pyrazoloazole couplers (I-a) and (I-b) which can be used in this invention are illustrated below but this invention is not limited to these.

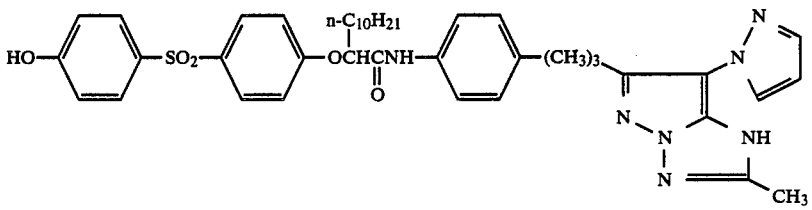

(M-1)

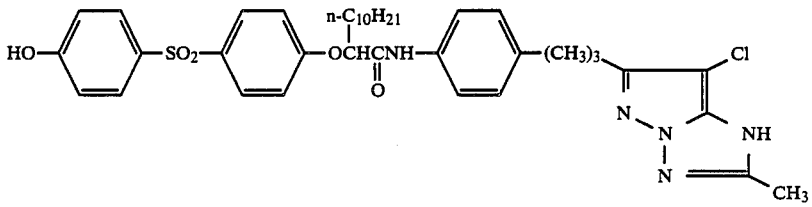

(M-2)

-continued
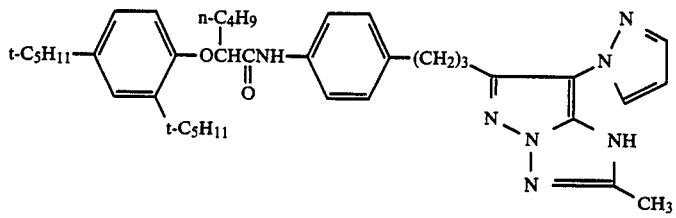
(M-3)
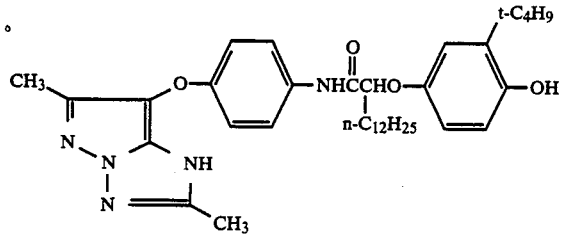
(M-4)
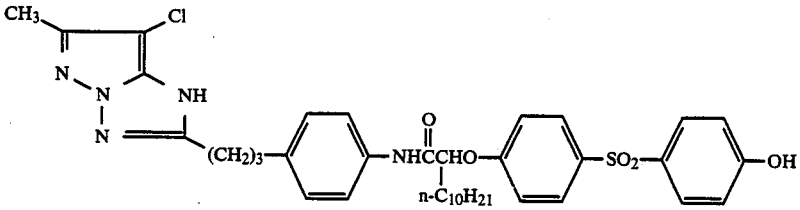
(M-5)
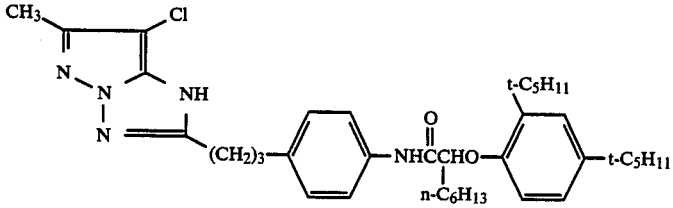
(M-6)
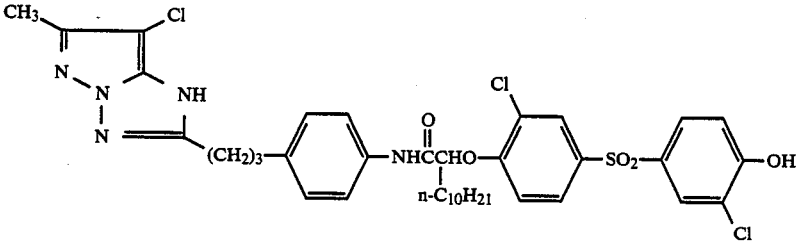
(M-7)
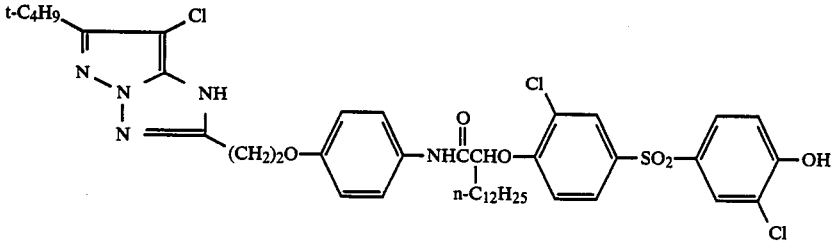
(M-8)
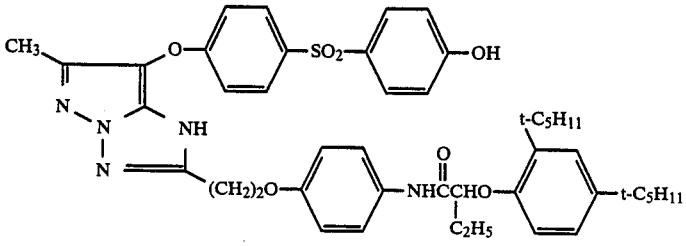
(M-9)

-continued
(M-10)
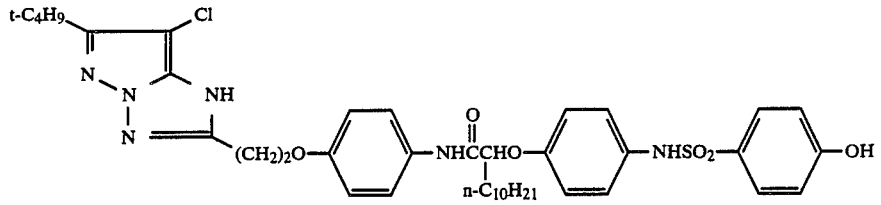
(M-11)
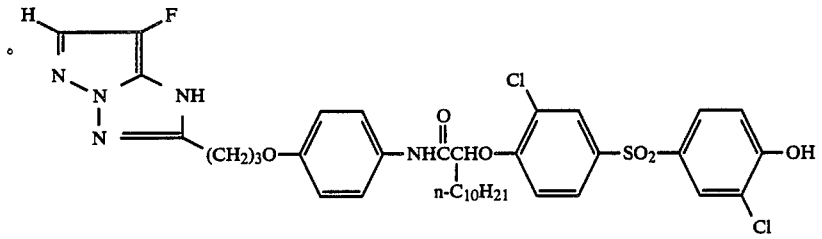
(M-12)
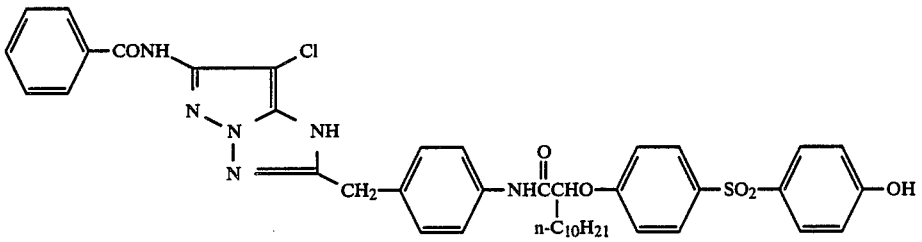
(M-13)
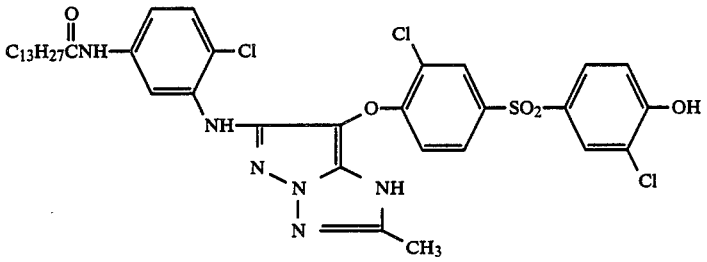
(M-14)
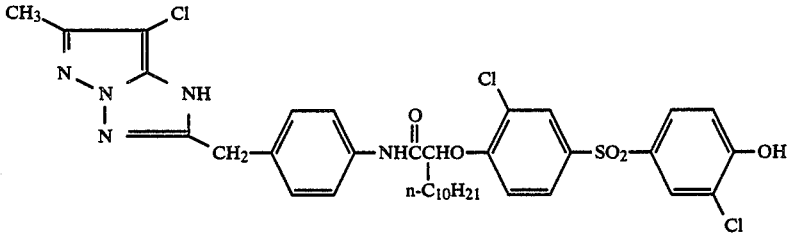
(M-15)
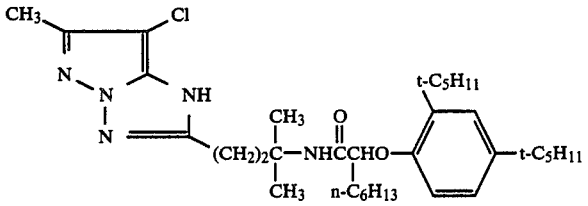
(M-16)
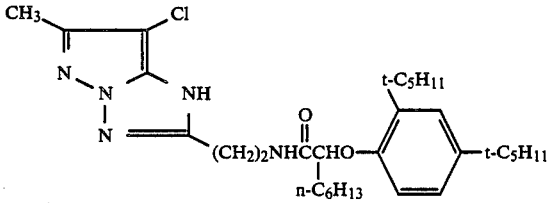

-continued
(M-17)
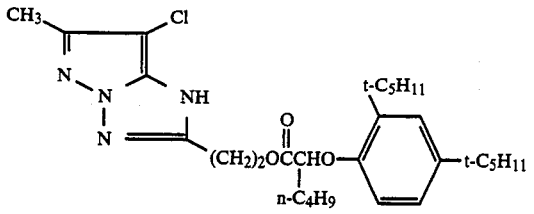
(M-18)
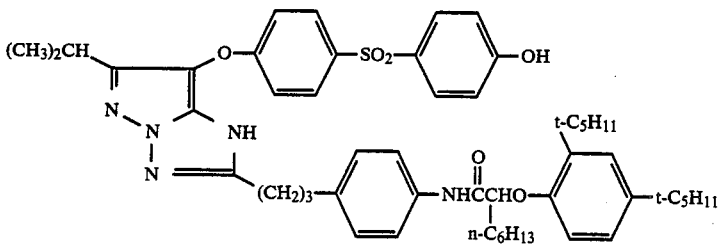
(M-19)
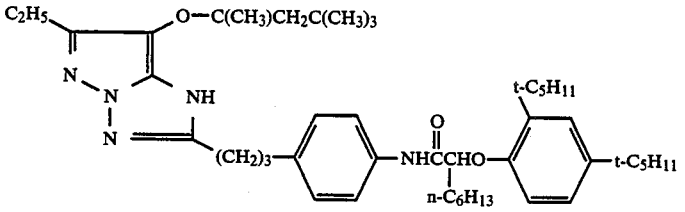
(M-20)
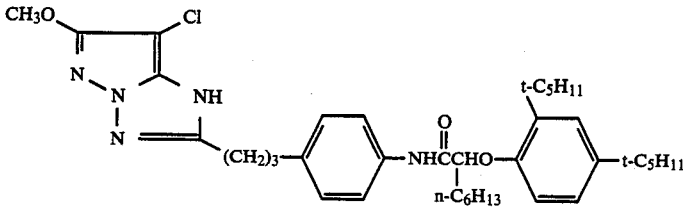
(M-21)
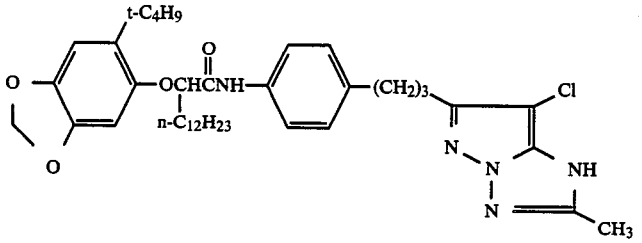
(M-22)
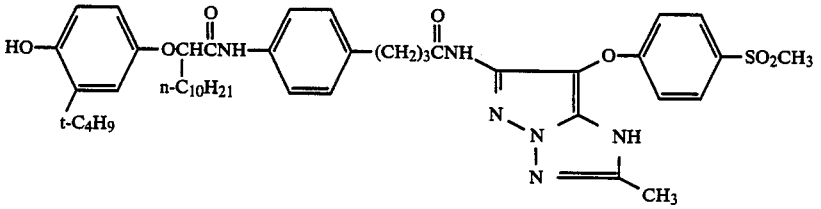
(M-23)
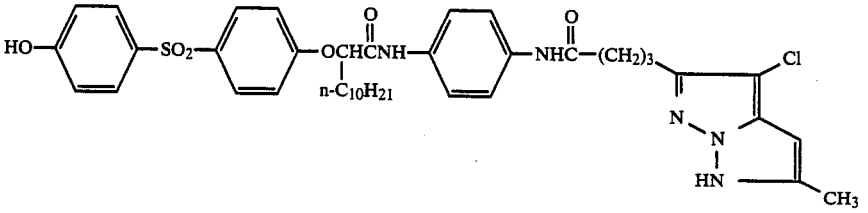

-continued
(M-24)
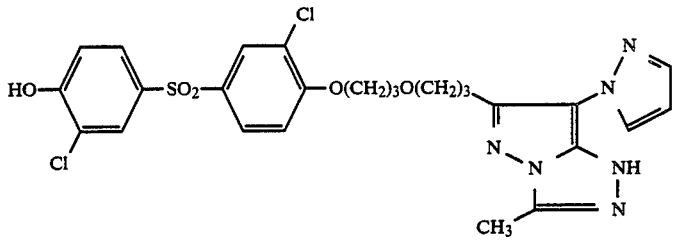
(M-25)
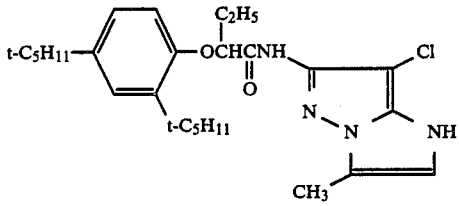
(M-26)
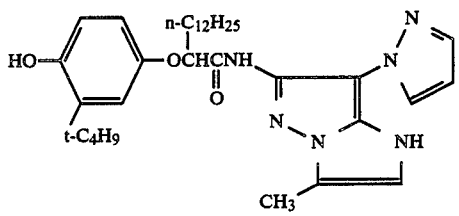
(M-27)
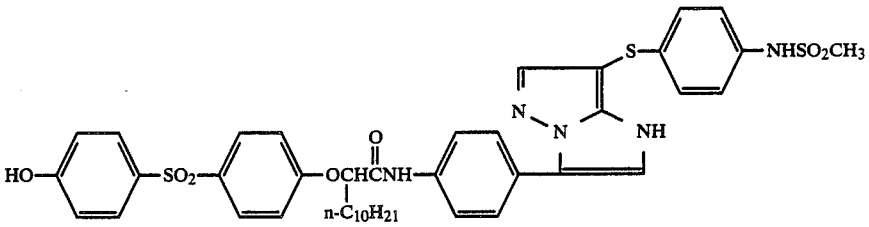
(M-28)
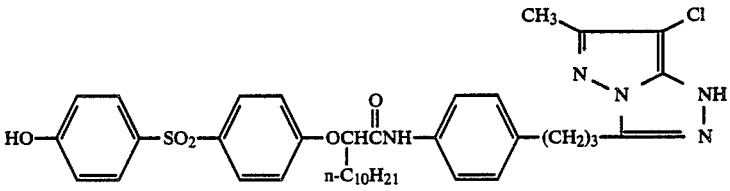
(M-29)
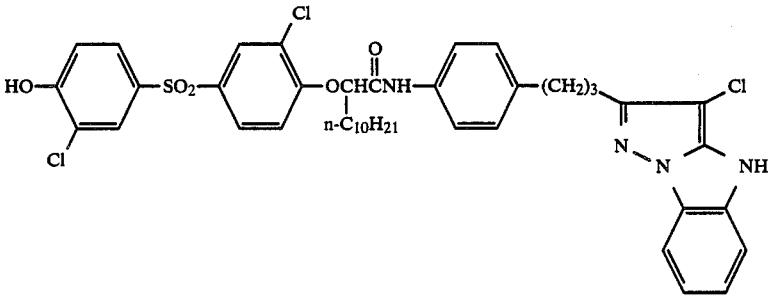

-continued
(M-30)
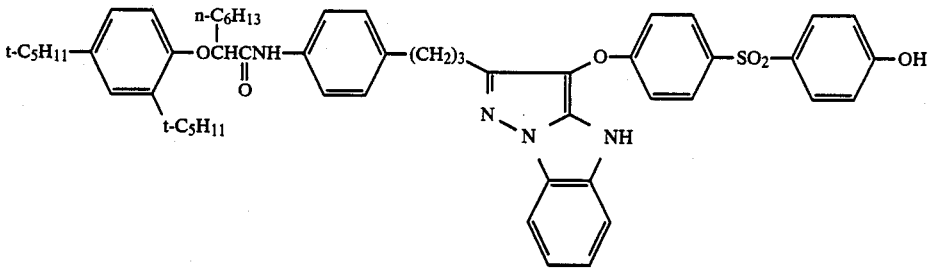
(M-31)
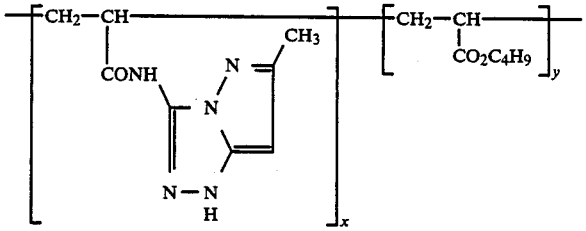
x:y = 50:50 (wt.)
(M-32)
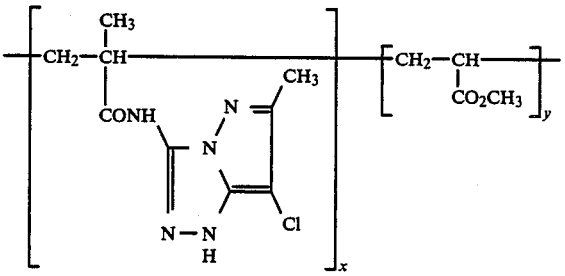
x:y = 40:60
(M-33)
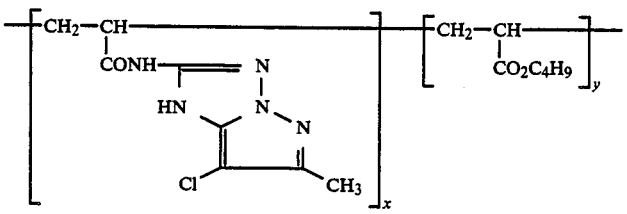
x:y = 50:50 (wt.)
(M-34)
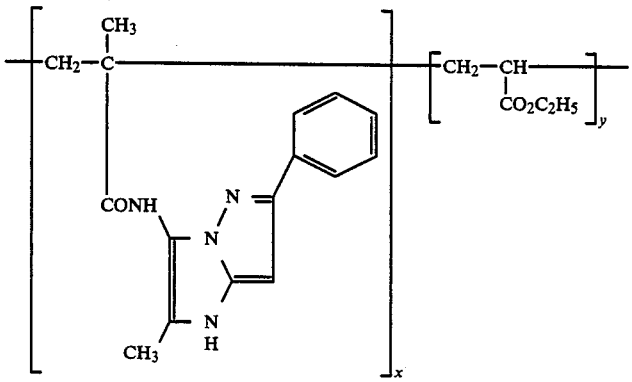
x:y = 55:45 (wt.)

-continued (M-35)

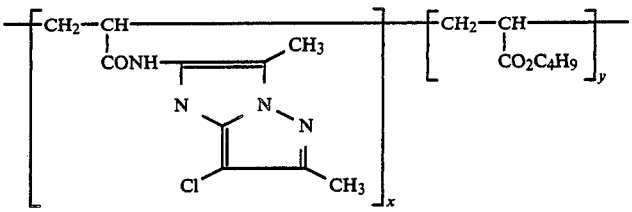

x:y = 50:50 (wt.)

The coupler (II-a) represented by the formula (II) will now be explained in detail.

In the formula (II), $R_1$ represents carbonamido, anilino or ureido group, $R_2$ represents phenyl group and X represents a group which can be split off upon the coupling reaction with the oxidation products of an aromatic primary amine developing agent.

X represents an aliphatic group, an aromatic group, a heteroring group, an aliphatic, aromatic or heteroring sulfonyl, an aliphatic aromatic or heteroring carbonyl or carbamoyl group, an alkoxy carbonyl group, or an aryloxycarbonyl group which contains an oxygen, nitrogen or sulfur atom through which X is linked to the cabron atom at the coupling position, a halogen atom, a heteroring or an aromatic azo group. The aliphatic, aromatic or heteroring group contained in X, $R_1$ and $R_2$ may further be substituted by any substituent, e.g. halogen (e.g., fluorine, chlorine, bromine, etc.), alkyl (e.g., methyl, t-octyl, dodecyl, trifluoromethyl, etc.), alkenyl (e.g., allyl, octadecenyl, etc.), aryl (e.g., phenyl, p-tolyl, naphthyl, etc.), alkoxy (e.g., methoxy, benzyloxy, methoxyethoxy, etc.), aryloxy (e.g., phenoxy, 2,4-di-t-amylphenoxy, 3-t-butyl-4-hydroxyphenoxy, etc.), acyl (e.g., acetyl, benzoyl, etc.), sulfonyl (e.g., methanesulfonyl, toluenesulfonyl, etc.), carboxy, sulfo, cyano, hydroxy, amino (e.g., amino, dimethylamino, etc.), carbonamido (e.g., acetamido, trifluoroacetamido, tetradecaneamido, benzamido, etc.), sulfonamido (e.g., methanesulfonamido, hexadecanesulfonamido, p-toluenesulfonamido, etc.), acyloxy (e.g., acetoxy, etc.), sulfonyloxy (e.g., methanesulfonyloxy, etc.), alkoxycarbonyl (e.g., dodecyloxycarbonyl, etc.), aryloxycarbonyl (e.g., phenoxycarbonyl, etc.), carbamoyl (e.g., dimethylcarbamoyl, tetradecylcarbamoyl, etc.), sulfamoyl (e.g., methylsulfamoyl, hexadecylsulfamoyl, etc.), imido (e.g., succinimido, phthalimido, octadecenylsuccinimide, etc.), heteroring (e.g., 2-pyridyl, 2-furyl, 2-thienyl, etc.), alkylthio (e.g., methylthio, etc.), or arylthio (e.g., phenylthio, etc.). Specific examples of X include halogen (e.g., fluorine, chlorine, bromine, etc.), alkoxy (e.g., benzyloxy, etc.), aryloxy (e.g., 4-chlorophenoxy, 4-methoxyphenoxy, etc.), acyloxy (e.g., acetoxy, tetradecanoyloxy, benzoyloxy, etc.), aliphatic or aromatic sulfonyloxy (e.g., methanesulfonyloxy, toluenesulfonyloxy, etc.), carbonamide (e.g., dichloroacetamido, trifluoroacetamido, etc.), aliphatic or aromatic sulfonamido (e.g., metanesulfonamido, p-toluenesulfonamido, etc.), alkoxycarbonyloxy (e.g., ethoxycarbonyloxy, benzyloxycarbonyloxy, etc.), aryloxycarbonyloxy (e.g., phenoxycarbonyloxy, etc.), aliphatic, aromatic or heteroring thio (e.g., ethylthio, hexadecylthio, 4-dodecylphenylthio, pyridylthio, etc.), ureido (e.g., methylureido, phenylureido, etc.), nitrogen-containing 5- or 6-membered heteroring (e.g., imidazolyl, pyrazolyl, triazolyl, tetraazolyl, 1,2-dihydro-2-oxo-1-pyridyl, etc.), imido (e.g., succinimido, phthalimido, hydantoinyl, etc.) and aromatic azo (e.g., phenylazo, etc.). Examples of the couplers comprising two split-off groups which are linked to each other through a carbon atom include bis-type couplers which are obtained by condensing four-equivalent coupler with aldehyde or ketone.

The coupler (II-b) comprises two or more residues which are obtained by removing $R_1$, $R_2$ or X from the formula (II) and which are linked to each other through a bivalent or polyvalent linkage, or attached to the main chain of the polymer described earlier.

It is known in the art that the compounds represented by the formula (II) exhibit keto-enol type tautomerism as follows:

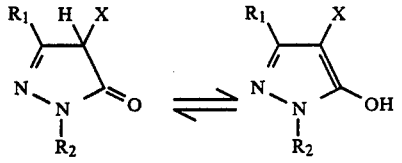

Examples of the couplers (II-a) and (II-b) and methods for the synthesis thereof are described in, for example Japanese Patent Application (OPI) Nos. 49-111631, 54-48540, 55-62454, 55-118034, 56-38043, 56-80045, 56-126833, 57-4044, 57-35858, 57-94752, 58-17440, 58-50537, 58-85432, 58-117546, 58-126530, 58-145944 and 58-205151, Japanese Patent Publication Nos. 54-170, 54-10491, 54-21258, 53-46452, 53-46453 and 57-36577, Japanese Patent Application (OPI) Nos. 60-2953 and 60-23855 and Japanese Patent Application No. 59-26729, and U.S. Pat. Nos. 3,227,554, 3,432,521, 4,310,618 and 4,351,897.

In this invention, preferred compounds are those from which azole compounds are split off.

5-pyrazolone type two-equivalent couplers (II-a) and (II-b) are illustrated below but it should be understood that this invention is not limited to these.

(m-1)
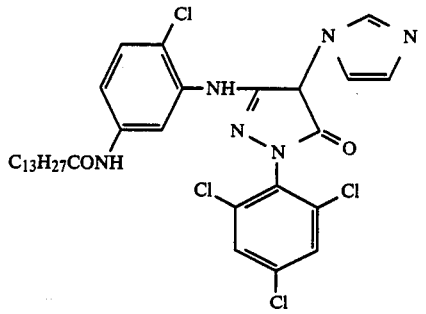
(m-2)
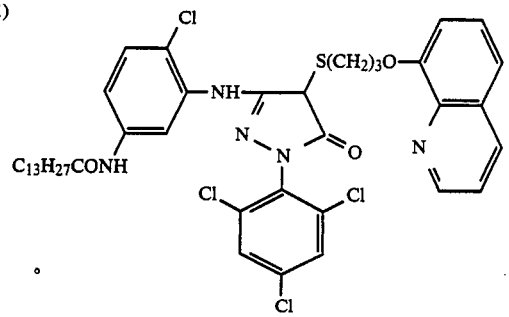
(m-3)
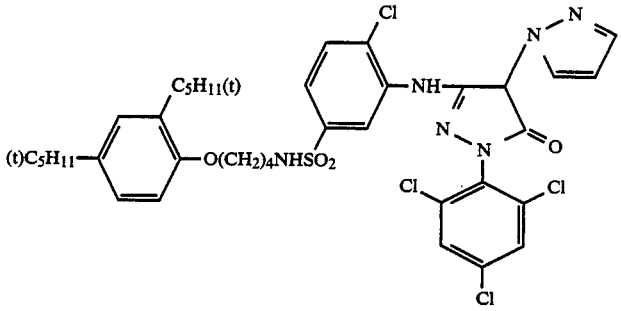
(m-4)
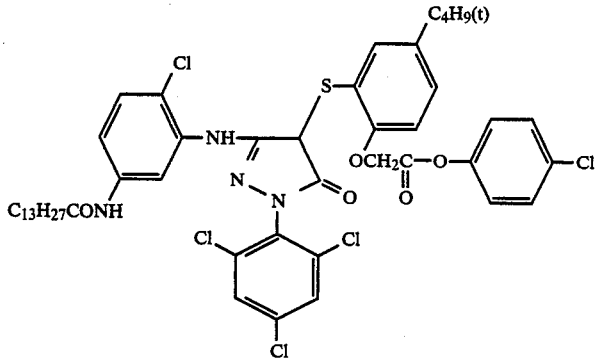
(m-5)
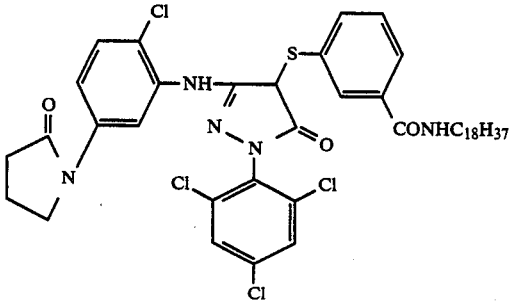
(m-6)
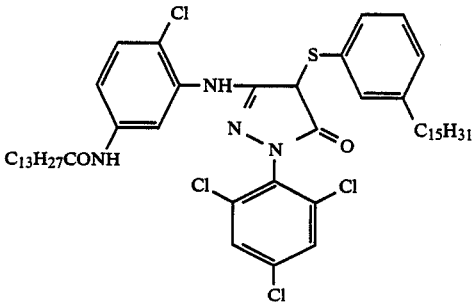
(m-7)
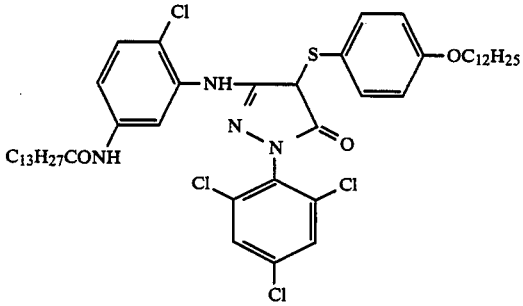

-continued
(m-8)
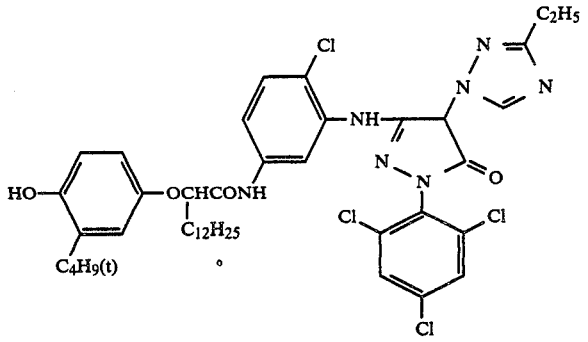
(m-9)
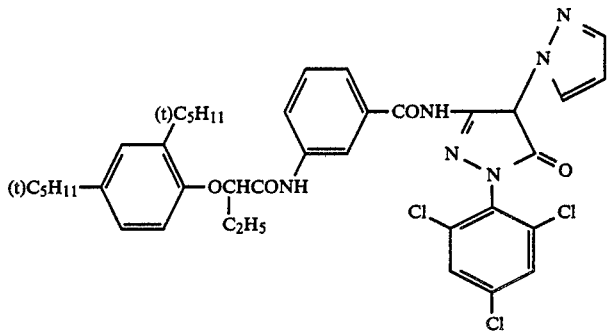
(m-10)
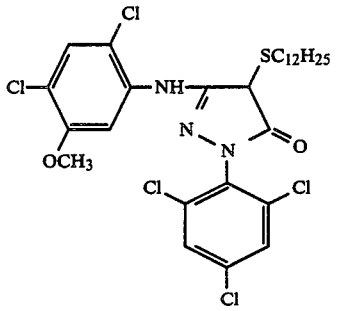
(m-11)
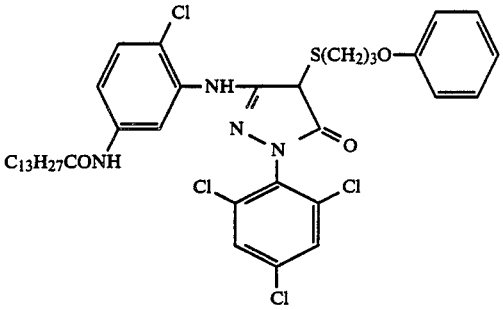
(m-12)
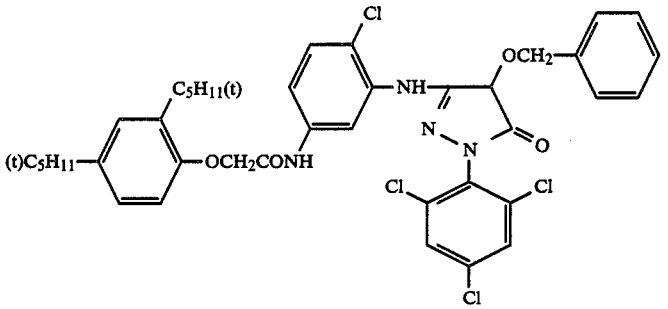
(m-13)
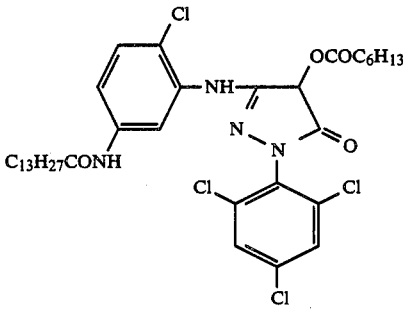

-continued
(m-14)
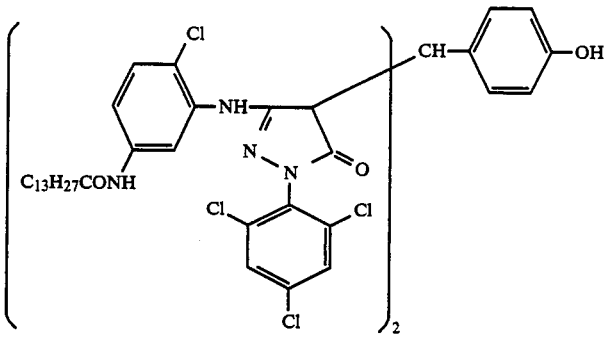
(m-15)
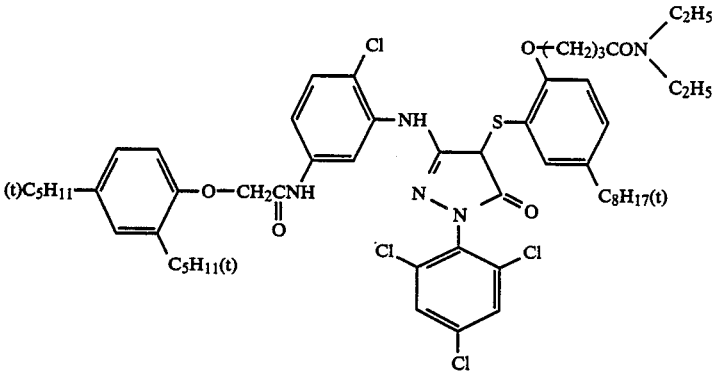
(m-16)
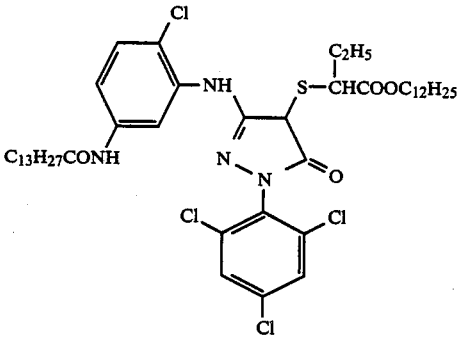
(m-17)
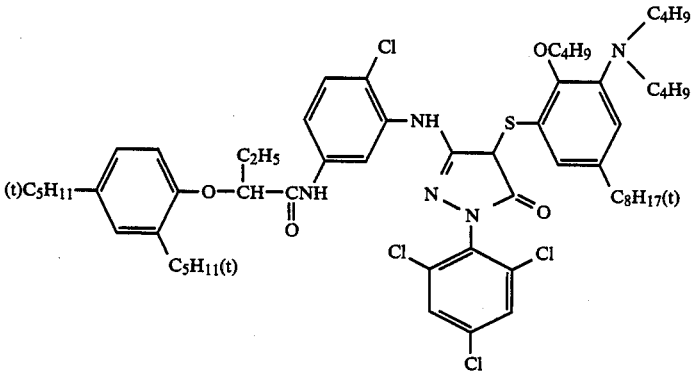

-continued
(m-18)
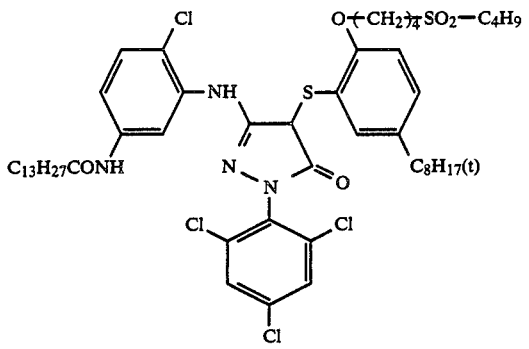
(m-19)
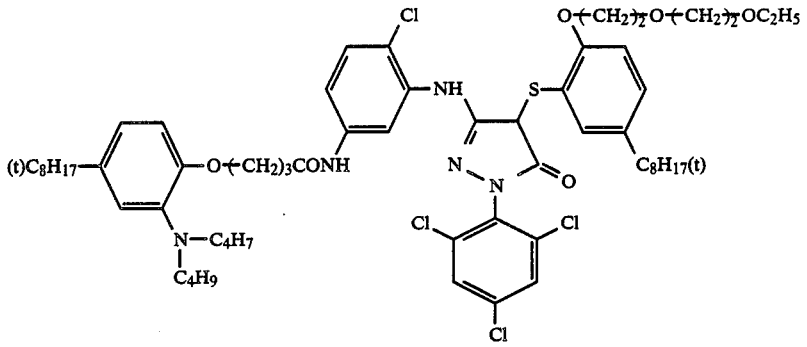
(m-20)
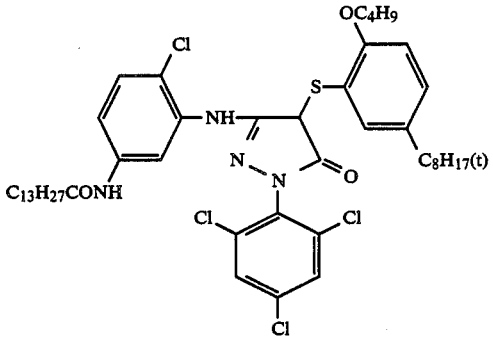
(m-21)
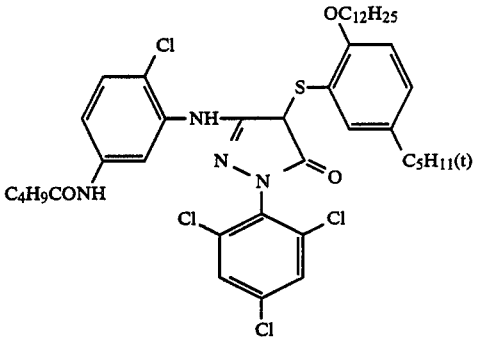
(m-22)
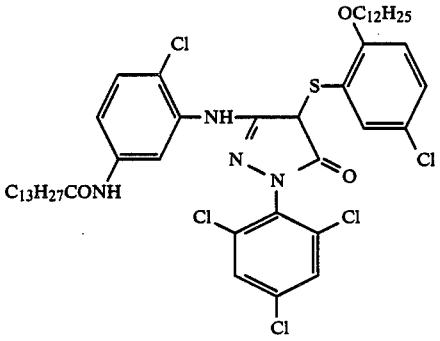
(m-23)
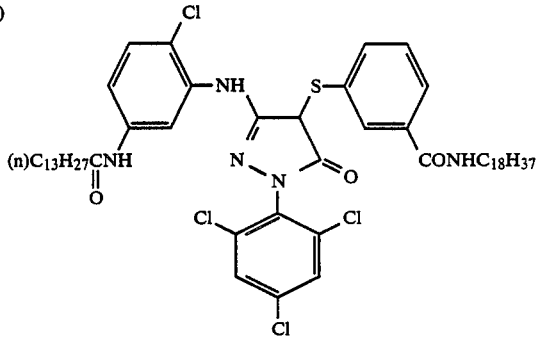

-continued
(m-24)
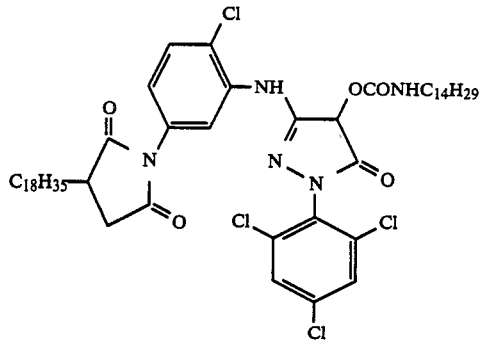
(m-25)
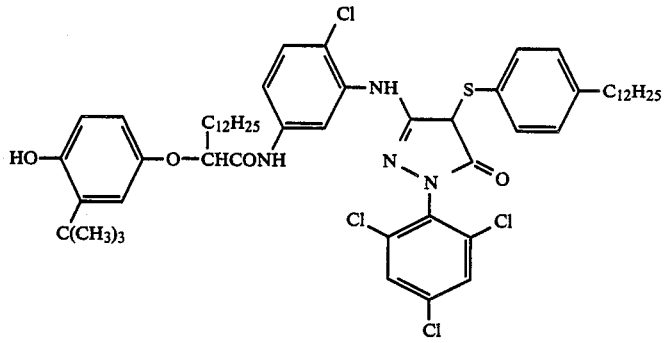
(m-26)
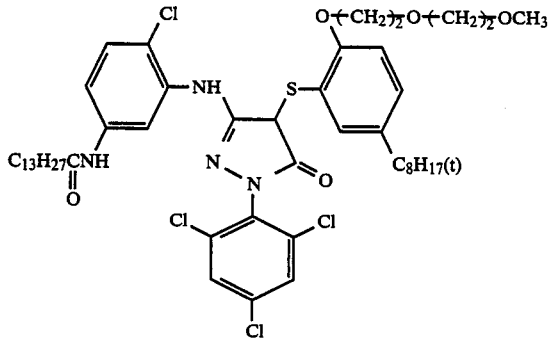
(m-27)
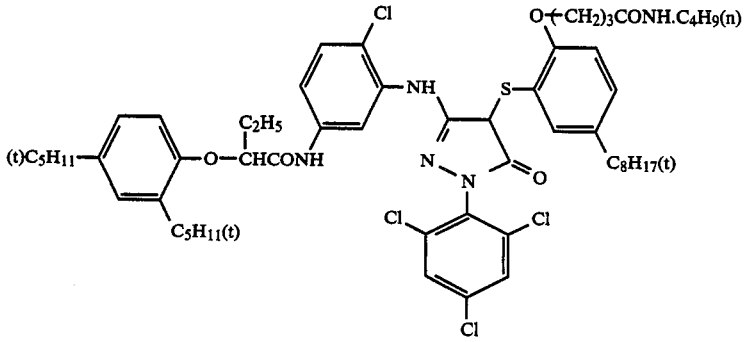
(m-28)
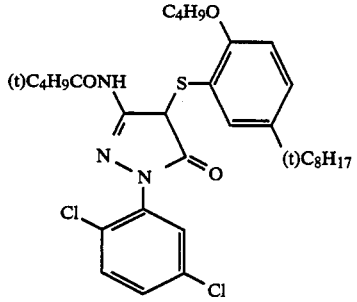

-continued
(m-29)
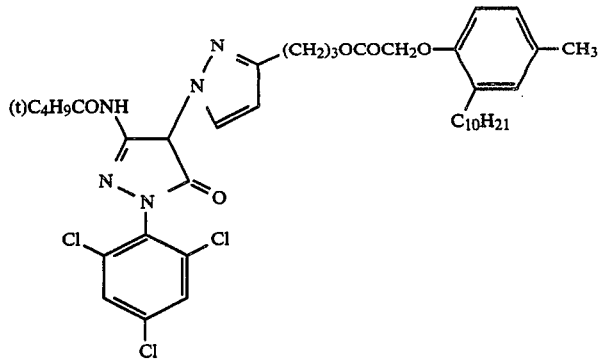
(m-30)
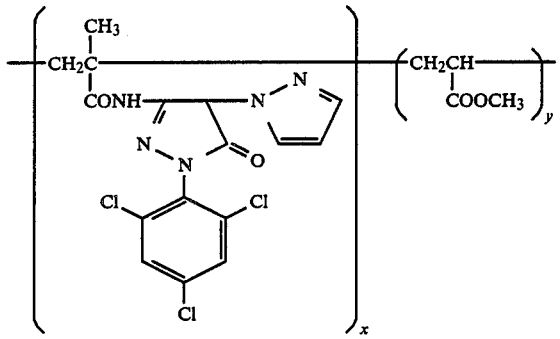
x/y = 60/40 (wt)
(m-31)
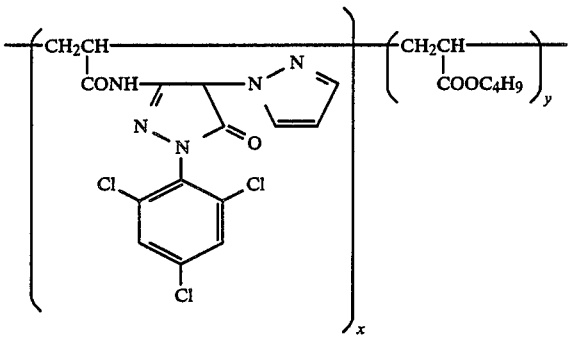
x/y = 50/50 (wt)
(m-32)
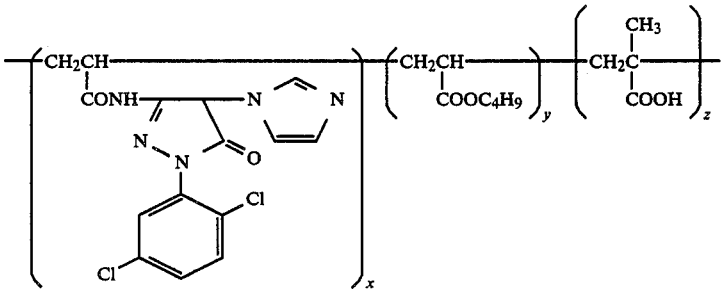
x/y/z = 45/45/10 (wt)

-continued
(m-33)
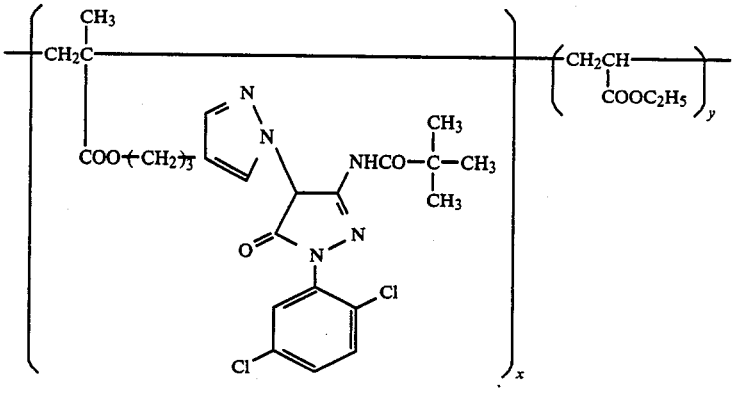
x/y = 60/40 (wt)
(m-34)
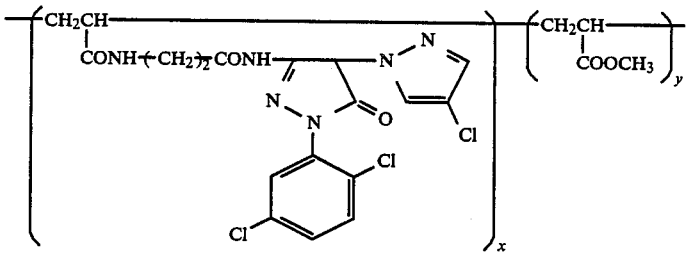
x/y = 50/50 (wt)
(m-35)
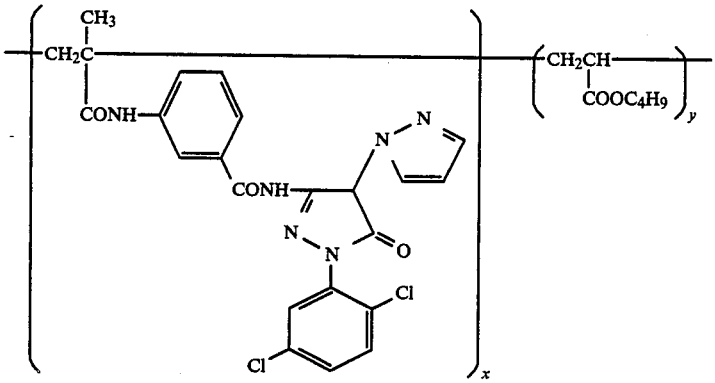
x/y = 55/45 (wt)
(m-36)
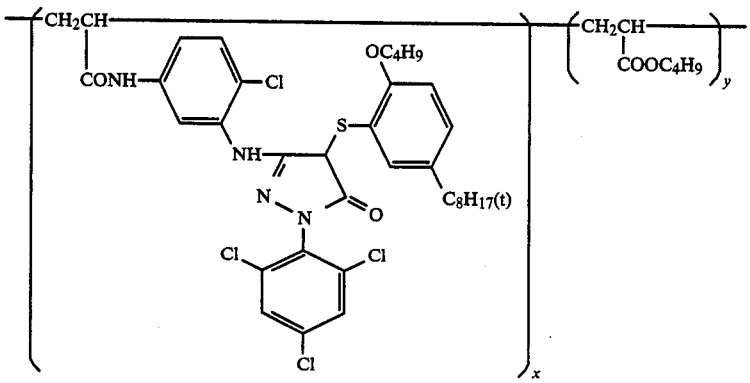
x/y = 50/50 (wt)

-continued
(m-37)
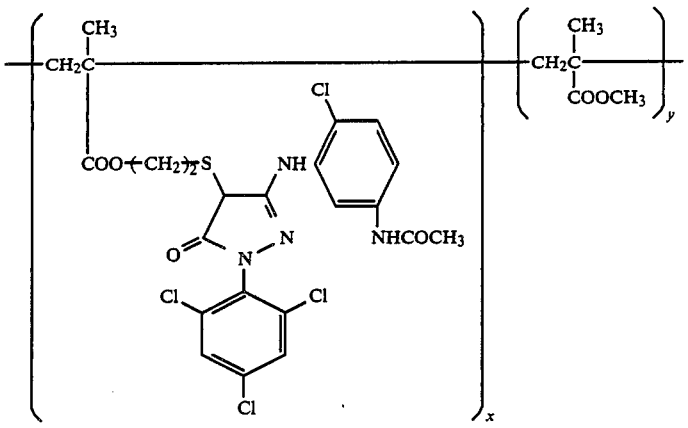
x/y = 45/55 (wt)
(m-38)
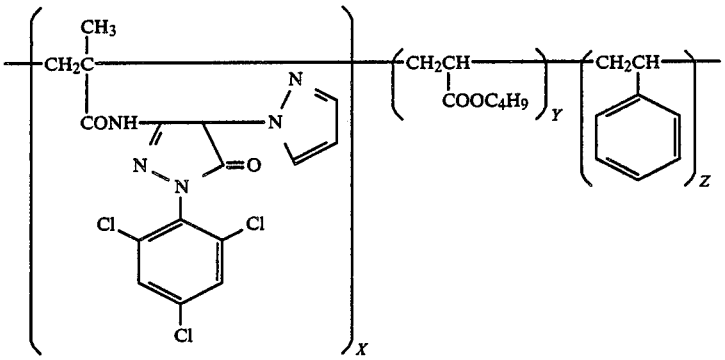
X/Y/Z = 50/25/25 (wt)
(m-39)
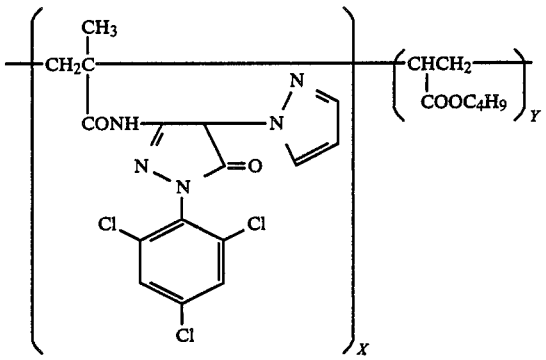
X/Y = 50/50 (wt)
(m-40)
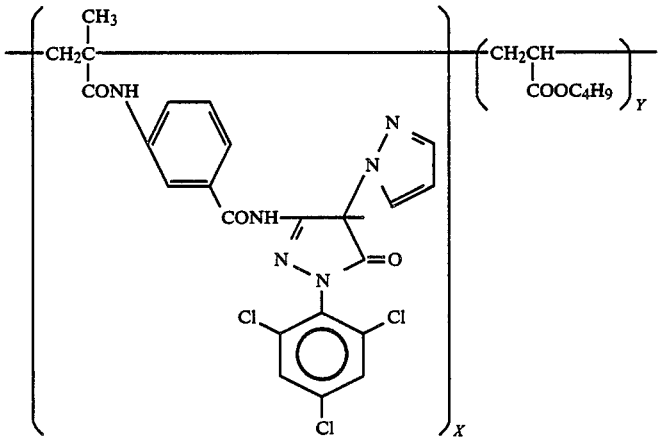

-continued

X/Y = 50/50 (wt)

(m-41)

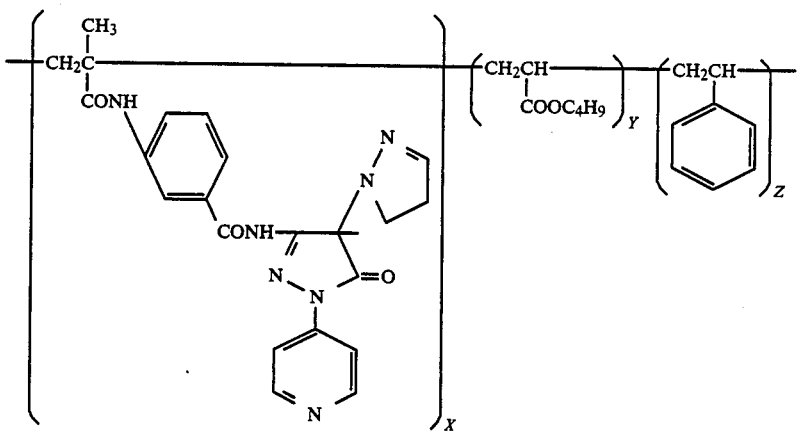

X/Y/Z = 50/25/25 (wt)

(m-42)

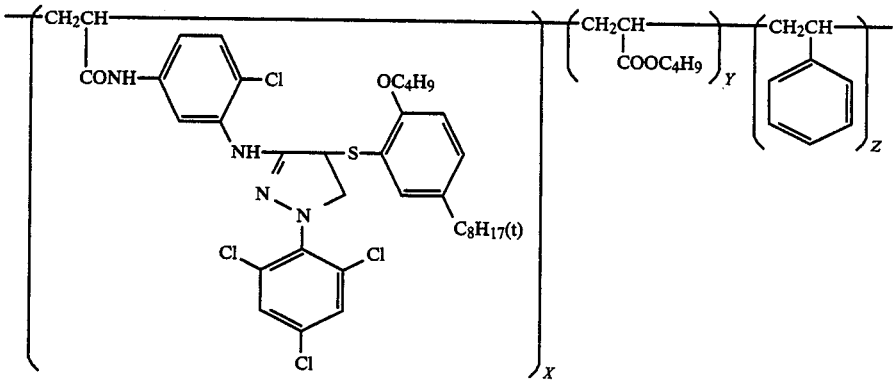

X/Y/Z = 50/25/25

Two or more kinds of the couplers may be incorporated in a single layer. A single compound selected from the couplers may be incorporated in two or more different layers.

The 2-equivalent magenta couplers described above are incorporated in the photographic material of this invention in the amount of $2\times10^{-3}$ mole to $5\times10^{-1}$ mole, preferably $1\times10^{-2}$ mole to $5\times10^{-1}$ mole per mole of silver incorporated in the emulsion layer. When couplers described later are used in combination with the 2-equivalent magenta couplers, it is preferred that the total amount of couplers which form compounds having the same color is in the range described above.

The couplers and other compounds described above can be incorporated in a silver halide emulsion layer by any conventional manner as described in, e.g. U.S. Pat. No. 2,322,027. For example, they are dissolved in a solvent such as phthalic acid alkyl esters (e.g. dibutyl phthalate, dioctyl phthalate, etc.), phosphates (e.g. diphenyl phosphate, triphenyl phosphate, tricresyl phosphate, dioctyl butyl phosphate, etc.), citrates (e.g. tributyl acetylcitrate, etc.), benzoates (e.g. octyl benzoate), alkylamides (e.g. diethyllaurylamide), aliphatic acid esters (e.g. dibutoxyethyl succinate, diethyl azelate, dioctyl azelate, etc.), trimesic acid esters (e.g. trimesic acid tributyl ester), etc., or organic solvents having a boiling point of about 30° C. to about 150° C., such as lower alkyl acetates (e.g. ethyl acetate, butyl acetate), ethyl propionate, sec-butyl alcohol, methyl isobutyl ketone, beta-ethoxyethyl acetate, methylcellosolve acetate, etc. and then dispersed into a hydrophilic colloid. A mixture of these high and low boiling point solvents may also be used.

The dispersing method using the polymer as described in Japanese Patent Publication No. 51-39853 and Japanese Patent Application (OPI) No. 51-59943 may also be used.

Couplers having an acid group such as carboxyl or sulfonic may be introduced to a hydrophilic colloid in the form of an aqueous alkaline solution.

The process of this invention comprises such steps as color development, bleaching, fixing, etc. After the fixing or bleach-fixing step, water washing and stabilizing steps are usually provided. However, there can be used in this invention a simpler process wherein only the water washing or the stabilization without substantial water washing is carried out.

It is necessary in this invention to use two or more countercurrent washing baths or stabilizing baths, preferably 2 to 9 baths.

The amount of washing water or stabilizing solution to be replenished is 3 to 50 times, preferably 3 to 40 times the volume of the solution taken into the washing or stabilizing bath from the preceding bath, i.e., the fixing or bleach-fixing bath.

It is preferred that the above-mentioned relationship between the amount of washing water or stabilizing solution replenished or overflowed into the first water washing or stabilizing bath and that of the solution taken into the first bath from the preceding fixing or bleach-fixing bath also be held between the amount of washing water or stabilizing solution replenished or overflowed into each of the other baths and that of the washing water or stabilizing solution taken into the same bath from the preceding bath.

The washing water used in the water washing step may contain known additives, if necessary. Examples of the additives include chelating agents such as inorganic phosphoric acids, aminopolycarboxylic acids and organic phosphoric acids, germicides such as antimold agents or bactericides for the inhibition of propagation of bacteria or algae, hardening agents such as magnesium salts and aluminum salts, and surface active agents for the prevention of unevenness. The compounds as described in L. E. West, "Water Quality Criteria" Phot. Sci. and Eng., vol. 9 No. 6, page 344–359 (1965) can also be incorporated.

A solution in which a color image is stabilized is used as a stabilizer in the stabilizing step. Examples of the stabilizer include a buffer solution having a pH of 3 to 6 and an aldehyde-containing solution, e.g. formalin. The stabilizer may contain, if necessary, fluorescent whitening agents, chelating agents, germicides, hardening agents and surface active agents.

The stabilizing solution used in this invention may contain a buffer such as borates, metaborates, borax, phosphates, carbonates, potassium hydroxide, sodium hydroxide, ammonia water, monocarboxylic acids, dicarboxylic acids, polycarboxylic acids.

The stabilizing solution used in this invention may contain as an agent for controlling the pH of the film of the processed photographic material, various ammonium salts such as ammonium chloride, ammonium nitrate, ammonium sulfate, ammonium phosphate, ammonium sulfite, ammonium thiosulfate.

The washing water or stabilizing solution used in this invention may contain as a germicide (e.g., antimold agents, bactericides, etc.), 1,2-benzisothiazoline-3-one, 4-thiazolylbenzimidazole, isothiazolone compounds, halogenated phenolic compounds, disulfide compounds, sulfamine agents, etc., preferably in the amount of 1 to 5000 ppm.

The washing water or stabilizing solution preferably contains a chelating agent in order to stabilize it. Examples of the chelating agent include inorganic phosphoric acids, aminopolycarboxylic acids, organic phosphoric acids, phosphonocarboxylic acids, etc., specific examples of which are illustrated below. This invention is, however, not limitd to these.

$Na_4P_4O_{12}$ F-1

$Na_6P_4O_{13}$ F-2

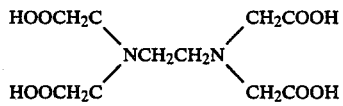

F-3

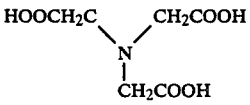

F-4

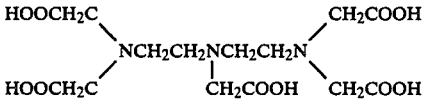

F-5

-continued

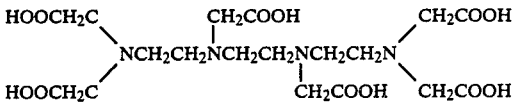

F-6

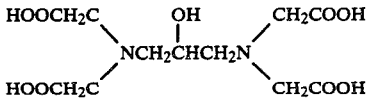

F-7

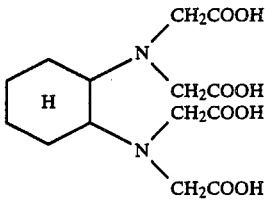

F-8

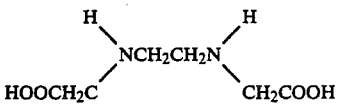

F-9

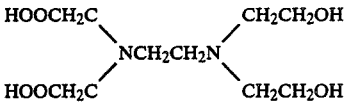

F-10

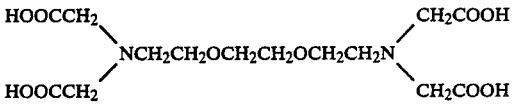

F-11

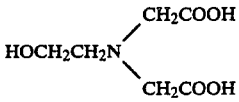

F-12

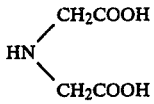

F-13

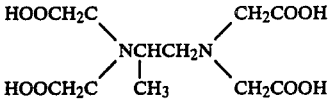

F-14

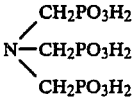

F-15

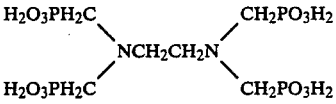

F-16

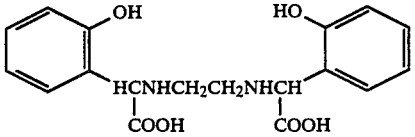

F-17

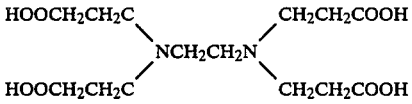

F-18

-continued

F-19

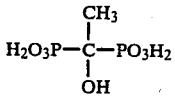

F-20

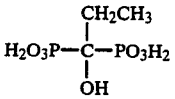

F-21

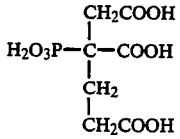

F-22

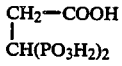

F-23

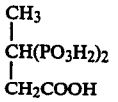

F-24

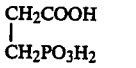

F-25

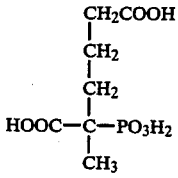

F-26

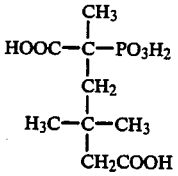

F-27

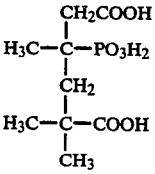

F-28

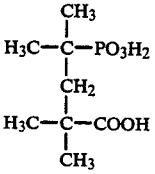

F-29

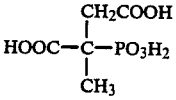

-continued

F-30

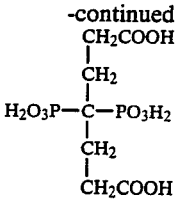

F-31

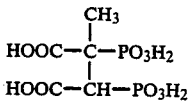

F-32

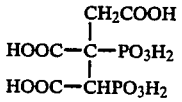

F-33

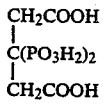

Salts such as magnesium, calcium, bismuth, lithium, sodium, potassium, ammonium, iron or zinc of these carboxylic acids or phosphoric acids may also be used.

The chelating agents can be contained in the washing water or stabilizing solution in a concentration of $1\times10^{-7}$ to $1\times10^{-1}$ mole/liter, preferably $2\times10^{-6}$ to $1\times10^{-2}$ mole/liter.

The chelating agents may be added to the water washing or stabilizing bath or to the preceding developing, bleaching, fixing and/or bleach-fixing bath, because the agents contained in the preceding bath can be taken into the water washing or stabilizing bath.

The temperature of the water washing or stabilizing bath is not particularly limited but it is usually in the range of 5° to 45° C., preferably in the range of 10° to 40° C.

The process of this invention can be applied to the processing of all types of silver halide color photographic materials for photography such as color negative film and color reversal film.

Typical processing steps of this invention are illustrated below but it should be understood that this invention is not limited to these.

A. Color development-bleaching-water washing-fixing-water washing-final stabilizing-drying B. Color development-bleaching-fixing-water washing-drying C. Color development-bleaching-fixing-water washing-final stabilizing-drying D. Color development-bleaching-bleach-fixing-water washing-final stabilizing-drying E. Color development-bleach-fixing-water washing-drying F. First development-water washing-reversal-color development-conditioning bath-bleaching-fixing-water washing-final stabilizing-drying G. First development-water washing-reversal-color development-bleaching-fixing-water washing-final stabilizing-drying H. First development-water washing-reversal-color development-bleach-fixing-water washing-drying In the processes described above, "water washing step" may be replaced by "stabilizing step". In the processes B, E, and H, "water washing step" may be replaced by "water washing-stabilizing".

The color developing solution used in this invention contains a color developing agent. Preferred examples of the color developing agent are p-phenylenediamine derivatives, typical examples of which are illustrated below but it should be understood that this invention is not limited to these.

D-1 N,N-Diethyl-p-phenylenediamine
D-2 2-Amino-5-diethylaminotoluene
D-3 2-Amino-5-(N-ethyl-N-laurylamino)toluene
D-4 4-[N-ethyl-N-(beta-hydroxyethyl)amino]aniline
D-5 2-Methyl-4-[N-ethyl-N-(beta-hydroxyethyl-)amino]aniline
D-6 N-Ethyl-N-(beta-methanesulfonamidoethyl)-3-methyl-4-aminoaniline
D-7 N-(2-Amino-5-diethylaminophenylethyl)methanesulfonamide
D-8 N,N-Dimethyl-p-phenylenediamine
D-9 4-Amino-3-methyl-N-ethyl-N-methoxyethylaniline
D-10 4-Amino-3-methyl-N-ethyl-N-beta-ethoxyethylaniline
D-11 4-Amino-3-methyl-N-ethyl-N-beta-butoxyethylaniline Sulfates, hydrochlorides, sulfites, p-toluenesulfonates, etc. of these p-phenylenediamine derivatives may also be used. These compounds are described in U.S. Pat. Nos. 2,193,015, 2,552,241, 2,566,271, 2,592,364, 3,656,950 and 3,698,525. The aromatic primary amine developing agents are used in a concentration of about 0.1 g to about 20 g, preferably about 0.5 g to about 10 g per liter of the developing solution.

The color developing solution used in this invention may contain hydroxylamines, as is well known. Although the hydroxylamines may be contained in the form of free amine, they are usually used in the form of acid salt, typical examples of which include sulfates, oxalates, chlorides, phosphates, carbonates, acetates, etc. Hydroxylamines may be substituted or unsubstituted. For example, alkyl hydroxylamines can be used.

The color developing solution used in this invention preferably has a pH of 9 to 12, more preferably 9 to 11 and may contain any compounds used in a conventional developing solution. For example, there may be used as an alkali agent or a pH buffer, sodium hydroxide, potassium hydroxide, sodium carbonate, potassium carbonate, sodium phosphate, potassium phosphate, potassium metaborate, borax or a mixture thereof. There may be used various salts such as disodium or dipotassium hydrogenphosphate, potassium or sodium dihydrogenphosphate, sodium or potassium bicarbonate, boric acid, alkali metal nitrates or alkali metal sulfates in order to impart buffering capacity or to increase ion strength or for the convenience of preparation.

The color developing solution may also contain various chelating agents for the prevention of precipitation of calcium or magnesium. Examples of such chelating agents include polyphosphates, aminopolycarboxylic acids, phosphorocarboxylic acids, aminopolyphosphonic acids, 1-hydroxyalkylidene-1-,1-diphosphonic acids, etc.

The color developing agents used in this invention may contain development accelerating agents, if necessary. For example, there may be used neutral salts such as thallium nitrate or potassium nitrate, cationic dyes such as phenosalfranine cationic compounds such as various pyrimidium compounds as disclosed in U.S. Pat. Nos. 2,648,604 and 3,171,247 and Japanese Patent Publication No. 44-9503, nonionic compounds such as polyethylene glycols and derivatives thereof and polythioethers as disclosed in Japanese Patent Publication No. 44-9304 and U.S. Pat. Nos. 2,533,990, 2,531,832, 2,950,970 and 2,577,127, and thioethers as disclosed in U.S. Pat. No. 3,201,242.

There may be also be contained such commonly used preservatives as sodium sulfite, potassium, sulfite, sodium bisulfite or potassium bisulfite.

The color developing solution used in this invention may contain an antifoggant, if necessary. Alkali metal halides such as potassium bromide, sodium bromide or potassium iodide and organic antifoggants can be used. Examples of the organic antifoggants include benzotriazole, 6-nitrobenzimidazole, 5-nitroisoindazole, 5-methylbenzotriazole, 5-nitrobenzotriazole, 5-chlorobenzotriazole and 2-thiazolyl-benzimidazole.

The bleaching agents of the bleaching or bleach-fixing solution used in this invention are ferric ion complexes such as complexes of ferric ion and a chelating agent such as an aminopolycarboxylic acid, aminopolyphosphonic acid or salt thereof. Examples of salts of aminopolycarboxylic aicds or aminopolyphosphonic acids include those of alkali metals, such as sodium, potassium, lithium, etc., ammonium or water soluble amines, such as alkylamines (e.g. methylamine, diethylamine, triethylamine, butylamine, etc.), alicyclic amines (e.g., cyclohexylamine), aryl amines (e.g., aniline and m-toluidine) and heterocyclic amines (e.g., pyridine, morpholine and piperidine).

Typical examples of these chelating agents such as aminopolycarboxylic acids, aminopolyphosphonic acids or salts thereof are illustrated below but it should be understood that this invention is not limited to these.

Ethylenediaminetetraacetic acid
Ethylenediaminetetraacetic acid disodium salt
Ethylenediaminetetraacetic acid diammonium salt
Ethylenediaminetetraacetic acid tetra(trimethylammonium) salt
Ethylenediaminetetraacetic acid tetrasodium salt
Ethylenediaminetetraacetic acid trisodium salt
Diethylenetriaminepentaacetic acid
Diethylenetriaminepentaacetic acid pentasodium salt
Ethylenediamine-N-(beta-oxyethyl)-N,N',N'-triacetic acid
Ethylenediamine-N-(beta-oxyethyl)-N,N',N'-triacetic acid trisodium salt
Ethylenediamine-N-(beta-oxyethyl)-N,N',N'-triacetic acid triammonium salt
Propylenediaminetetraacetic acid
Propylenediaminetetraacetic acid disodium salt
Nitrilotriacetic acid
Nitrilotriacetic acid trisodium salt
Cyclohexanediaminetetraacetic acid
Cyclohexanediaminetetraacetic acid disodium salt
Iminodiacetic acid
Dihydroxyethylglycine
Ethyletherdiaminetetraacetic acid
Glycoletherdiaminetetraacetic acid
Ethylenediaminetetrapropionic acid
Phenylenediaminetetraacetic acid
1,3-Diaminopropanol-N,N',N,N'-tetramethylenephosphonic acid
Ethylenediamine-N,N,N',N'-tetramethylenephosphonic acid
1,3-Propylenediamine-N,N,N',N'-tetramethylenephosphonic acid.

Of these, ethylenediaminetetraacetic acid iron (III) complex salts and diethylenetriaminetetraacetic acid iron (III) complex salts are particularly preferred.

Ferric ion complexes may be added in the form of complex or may be formed in a solution by reacting a ferric salt (e.g., ferric sulfate, ferric chloride, ferric nitrate, ferric ammonium sulfate, ferric phosphate, etc.) and a chelating agent (e.g., aminopolycarboxylic acid, aminopolyphosphonic acid, phosphonocarboxylic acid, etc.). When used in the form of complex, one or more kinds of complexes may be used. When a complex is formed in a solution, one or more kinds of ferric salts and one or more kinds of chelating agents may be used. In both cases, a chelating agent may be used in an excessive amount to form a ferric ion complex. Of the ferric ion complexes, aminopolycarboxylic acid iron complexes are preferred and used in a concentration of 0.01 to 1.0 mole/liter, preferably 0.05 to 0.50 mole/liter.

Examples of fixing agents contained in the fixing or bleach-fixing solution include thiosulfates and thiocyanates, of which ammonium thiocyanate is preferred. Fixing agents are used in a concentration of 0.2 to 4 mole/liter. As a preservative, it is usual to add sulfites, although there may also be used ascorbic acid, carbonyl bisulfite adducts, carbonyl compounds, known bleach accelerating agents as described in U.S. Pat. No. 3,893,853 and Japanese Patent Application (OPI) No. 53-95630. There may also be used, if necessary, buffering agents, fluorescent whitening agents, chelating agents, germicides, etc.

The photographic material used in this invention may contain a color dye-forming coupler other than the magenta coupler described earlier. Preferably, such coupler is a nondiffusible one having a hydrophobic group called a ballast group in the molecule. The coupler may be 4- or 2-equivalent with respect to silver ion. The photographic material may contain a colored coupler having a color compensation effect or a coupler releasing a development restrainer upon development (the so-called DIR coupler). Such coupler may be one which forms a colorless compound upon coupling reaction.

As a yellow dye-forming coupler, open-chain ketomethylene type couplers which are known can be used. Of these, benzoylacetanilide and pivaloylacetanilide compounds are advantageous.

As a cyan coupler, phenolic and naphtholic compounds can be used. Particularly preferred are the phenolic cyan couplers having an acylamino group at 5-position and an ureido group at 2-position as described in Japanese Patent Application No. 59-102354. In addition, colored couplers and DIR couplers (particularly those which release a development restrainer having a high diffusibility) may also be used.

The photographic material of this invention may contain, in addition to DIR couplers, a compound which releases a development restrainer upon development, as described in U.S. Pat. Nos. 3,297,445 and 3,379,529, West German Patent Application (OLS) No. 2,417,914 and Japanese Patent Application (OPI) Nos. 52-15271 and 53-9116.

The photographic material of this invention may include an ultraviolet light absorber in the hydrophilic colloid layer. For example, there may be used aryl substituted benzotriazole compounds (e.g., as described in U.S. Pat. No. 3,533,794), 4-thiazolidone compounds (e.g., as described in U.S. Pat. Nos. 3,314,794 and 3,352,681), benzophenone compounds (e.g., as described in Japanese Patent Application (OPI) No. 46-2784), cinnamic acid esters (e.g., as described in U.S. Pat. Nos. 3,705,805 and 3,707,375), butadiene compounds (e.g., as described in U.S. Pat. No. 4,045,229), benzoxazole compounds (e.g., as described in U.S. Pat. No. 3,700,455) or compounds as described in U.S. Pat. No. 3,499,762 and Japanese Patent Application (OPI) No. 54-48535). There may also be used ultraviolet light-absorbing couplers (e.g. alpha-naphtholic cyan dye-forming couplers) or ultraviolet light-absorbing polymers. These ultraviolet light-absorbing compounds may be mordanted in a specific layer.

The photographic emulsion used in this invention can be prepared in any manner, e.g., by the methods as described in P. Glafkides, *Chimie et Physique Photographique,* Paul Montel (1967), G. F. Duffin, *Photographic Emulsion Chemistry,* The Focal Press (1966), and V. L. Zelikman et al., *Making and Coating Photographic Emulsion,* The Focal Press (1964).

In the photographic material used in this invention, there may be used silver halide grains of regular form and of nearly uniform size.

Two or more kinds of silver halide grains which are separately prepared may be used as a mixture.

The photographic emulsion of the photographic material used in this invention preferably is a negative type emulsion. Any type of silver halides can be used. Preferred examples of the silver halides include silver bromide, silver bromochloride, silver bromochloroiodide and silver bromoiodide which is particularly preferred. It is preferred that silver bromoiodide contains 2 to 15 mole % of silver iodide.

There may also be used an emulsion wherein tabular grains having a diameter-thickness ratio of at least 5, particularly at least 8, constitute 50% or more of the total projected area of silver halide grains.

The formation or physical ripening of silver halide grains may be carried out in the presence of cadmium salts, zinc salts, lead salts, thallium salts, iridium salts or its complex salts, rhodium salts or its complex salts, iron salts or its complex salts, and the like.

As a binder or protective colloid for the photographic material, it is advantageous to use gelatin, although other hydrophilic colloids may also be used.

The photographic emulsion used in this invention may include various compounds for the purpose of preventing fog formation or of stabilizing photographic performance in the photographic material during the production, storage or photographic processing thereof. For example, those compounds known as antifoggants or stabilizers can be incorporated, including azoles such as benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriaazoles, benzotriazoles, nitrobenzotriazoles, mercaptotetraazoles (particularly 1-phenyl-5-mercaptotetraazole), etc.; mercaptopyrimidines; mercaptotriazines; thioketo compounds such as oxazolinethione, etc.; azaindenes such as triazaindenes, tetraazaindenes (particularly 4-hydroxy-substituted(1,3,3a,7)tetraazaindenes), pentaazaindenes, etc.; benzenethiosulfonic acids; benzenesulfinic acids; benzenesulfonic amides; etc, which are described in e.g., U.S. Pat. Nos. 3,954,474 and 3,982,947 and Japanese Patent Publication No. 52-28,660.

The photographic material used in this invention may include in the emulsion layers polyalkyleneoxides or ether, ester or amine derivatives thereof, thioether compounds, thiomorpholines, quaternary ammonium salts, urethane derivatives, urea derivatives, imidazole derivatives, 3-pyrazolidones, etc. for the purpose of improvement of sensitivity or contrast or acceleration of development.

The photographic emulsion of the photographic material used in this invention may be spectrally sensitized by methine dyes, etc.

Such sensitizing dyes include cyanine dyes, merocyanine dyes, complex cyanine dyes, complex merocyanine dyes, holopolar cyanine dyes, hemicyanine dyes, styryl dyes and hemioxonol dyes. Especially useful dyes are cyanine dyes, merocyanine dyes and complex merocyanine dyes. In these dyes, there may be applied any nuclei conventionally used in cyanine dyes as basic hetero-ring nuclei such as pyrroline nucleus, oxazoline nucleus, thiazoline nucleus, pyrrole nucleus, oxazole nucleus, thiazole nucleus, selenazole nucleus, imidazole nucleus, tetraazole nucleus, pyridine nucleus, etc.; these nuclei with which a hydrocarbon ring is fused; these nuclei with an aromatic hydrocarbon ring is fused, i.e. indolenine nucleus, benzindolenine nucleus, indole nucleus, benzoxazole nucleus, naphthoxazole nucleus, benzothiazole nucleus, naphthothiazole nucleus, benzoselenazole nucleus, benzimidazole nucleus, quinoline nucleus, etc. These nuclei may be attached to a carbon atom.

In merocyanine dyes or complex merocyanine dyes, there may be applied, as a nucleus having ketomethylene structure, five or six member hetero-ring nuclei, such as, pyrazoline 5-one nucleus, thiohydantoine nucleus, 2-thiooxazolidine-2,4-dione nucleus, thiazolidine 2,4-dione nucleus, rhodanine nucleus, thiobarbituric acid nucleus.

The sensitizing dyes may be used individually or in combination. A combination of two or more sensitizing dyes is often used for supersensitization.

In addition to sensitizing dyes, the emulsion layer may contain a dye which does not have spectrally sensitizing effect or a compound which shows a supersensitizing effect but does not substantially absorb visible light.

The photographic material used in this invention may contain a water soluble dye in the hydrophilic colloid layer as a filter dye, or for other purposes, e.g., prevention of irradiation. Such water soluble dyes include oxonol dyes, hemioxonol dyes, styryl dyes, merocyanine dyes, cyanine dyes and azo dyes. Of these oxonol dyes, hemioxonol dyes and merocyanine dyes are particularly useful.

The photographic material used in this invention may contain in the photograhic emulsion layers or other hydrophilic colloid layers a whitening agent such as of stilbene, thiazine, oxazole or coumarine type, which may be water soluble or insoluble. The water insoluble whitening agent may be used in the form of dispersion.

The photographic material used in this invention may contain one or more discoloration preventing agents or one or more color image stabilizing agents. Known discoloration preventing agents include hydroquinone derivatives, gallic acid derivaties, p-alkoxyphenols, p-oxyphenols and bisphenols.

The photographic material used in this invention may contain an antistain agent such as hydroquinone derivatives, aminophenol derivatives, gallic acid derivatives, ascrobic acid derivatives, etc.

This invention can be applied to multilayer multicolor photographic materials comprising a support having thereon at least two emulsion layers which are different in speed. Multilayer natural color photographic materials usually comprise a support having thereon at least one red-sensitive emulsion layer, at least one green-sensitive emulsion layer and at least one blue-sensitive emulsion layer. The order in which the layers are provided on a support can be optionally selected. It is usual to incorporate a cyan dye-forming coupler in a red-sensitive layer, a magenta dye-forming coupler in a green-sensitive layer and a yellow dye-forming coupler in a blue-sensitive layer, although other combinations can be used.

The amount of silver incorporated in the photographic material used in this invention is generally 4 to 20 g/m$^2$, and preferably 5 to 15 g/m$^2$.

EXAMPLE

This invention will be explained in more detail by the following non-limitative Examples.

EXAMPLE 1

Layers having the following compositions were provided on a triacetylcellulose film support on which an undercoat layer had been provided, to prepare a multilayer color photographic material.

| | |
|---|---|
| **1st layer: Antihalation layer** | |
| Gelatin layer which contains black colloidal silver. | |
| **2nd layer: Interlayer** | |
| Gelatin layer which contains an emulsified dispersion of 2,5-di-t-octylhydroquinone. | |
| **3rd layer: Low speed red-sensitive emulsion layer** | |
| Silver bromoiodide emulsion (silver iodide: 5 mole %) | the amount of silver coated 1.6 g/m$^2$ |
| Sensitizing dye I | per mole of silver $6 \times 10^{-5}$ mole |
| Sensitizing dye II | per mole of silver $1.5 \times 10^{-5}$ mole |
| Coupler EX-1 | per mole of silver 0.04 mole |
| Coupler EX-5 | per mole of silver 0.003 mole |
| Coupler EX-6 | per mole of silver 0.0006 mole |
| **4th layer: High speed red-sensitive emulsion layer** | |
| Silver bromoiodide (silver iodide: 10 mole %) | the amount of silver coated 1.4 g/m$^2$ |
| Sensitizing dye I | per mole of silver $3 \times 10^{-5}$ mole |
| Sensitizing dye II | per mole of silver $1.2 \times 10^{-5}$ mole |
| Coupler EX-2 | per mole of silver 0.02 mole |
| Coupler EX-5 | per mole of silver 0.0016 mole |
| **5th layer: Interlayer** | |
| The same as that of the 2nd layer | |
| **6th layer: Low speed green-sensitive emulsion layer** | |
| Monodisperse silver bromoiodide emulsion (silver iodide: 4 mole %) | the amount of silver coated 1.2 g/m$^2$ |
| Sensitizing dye III | per mole of silver $3 \times 10^{-5}$ mole |
| Sensitizing dye IV | per mole of silver $1 \times 10^{-5}$ mole |

-continued

| | |
|---|---|
| Coupler as described in Table 1 | per mole of silver 0.05 mole |
| Coupler EX-8 | per mole of silver 0.008 mole |
| Coupler EX-6 | per mole of silver 0.0015 mole |
| **7th layer: High speed green-sensitive emulsion layer** | |
| Silver bromoiodide emulsion (silver iodide: 10 mole %) | the amount of silver coated 1.3 g/m$^3$ |
| Sensitizing dye III | per mole of silver $2.5 \times 10^{-5}$ mole |
| Sensitizing dye IV | per mole of silver $0.8 \times 10^{-5}$ mole |
| Coupler as described in Table 1 | per mole of silver 0.017 mole |
| Coupler EX-8 | per mole of silver 0.003 mole |
| Coupler EX-10 | per mole of silver 0.003 mole |
| **8th layer: Yellow filter layer** | |
| Gelatin layer comprising yellow colloidal silver and an emulsified dispersion of 2,5-di-t-octylhydroquinone in an aqueous gelatin solution. | |
| **9th layer: Low speed blue-sensitive emulsion layer** | |
| silver bromoiodide emulsion (silver iodide: 6 mole %) | the amount of silver coated 0.7 g/m$^2$ |
| Coupler EX-9 | per mole of silver 0.25 mole |

-continued

| | |
|---|---|
| Coupler EX-6 | per mole of silver 0.015 mole |
| **10th layer: High speed blue-sensitive emulsion layer** | |
| Silver bromoiodide emulsion (silver iodide: 6 mole %) | the amount of silver coated 0.6 g/m$^2$ |
| Coupler EX-9 | per mole of silver 0.06 mole |
| **11th layer: First protective layer** | |
| Silver bromoiodide (silver iodide 1 mole %, average grain size 0.07 micron) | the amount of silver coated 0.5 g |
| Gelatin layer containing an emulsified dispersion of an ultraviolet light absorbing agent UV-1 | |
| **12th layer: Second protective layer** | |
| Gelatin layer containing trimethyl methacrylate particles of about 1.5 microns in diameter. Gelatin hardening agent H-1 and/or surface active agent were added to each of the layers in addition to the compositions described above. (The compounds used to prepare the compositions) | |

Sensitizing dye I: anhydro-5,5'-dichloro-3,3'-di-(gamma-sulfopropyl)-9-ethylthiacarbocyanine-hydroxide.pyridinium salt Sensitizing dye II: anhydro-9-ethyl-3,3'-di-(gamma-sulfopropyl)-4,5,4',5'-dibenzothiacarbocyanine-hydroxide.triethylamine salt Sensitizing dye III: anhydro-9-ethyl-5,5'-dichloro-3,3'-di-(gamma-sulfopropyl)oxacarbocyanine.sodium salt Sensitizing dye IV: anhydro-5,6,5',6'-tetrachloro-1,1'-diethyl-3,3'-di-{beta-[beta-(gamma-sulfopropyl)ethoxy]ethyl} imidazolo-carbocyaninehydroxide.-sodium salt

EX-1

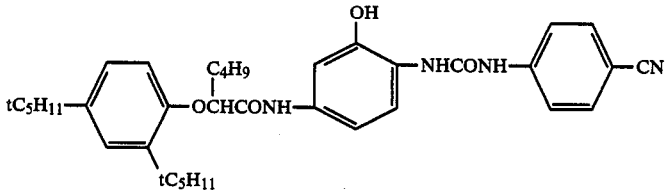

EX-2

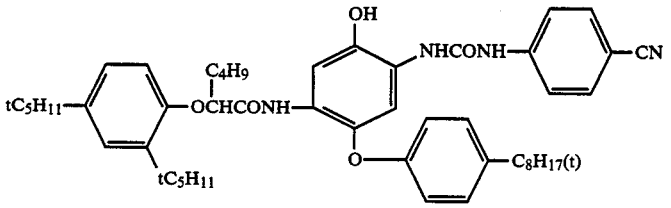

EX-5

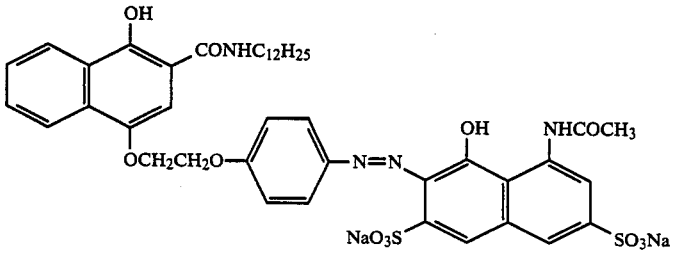

-continued

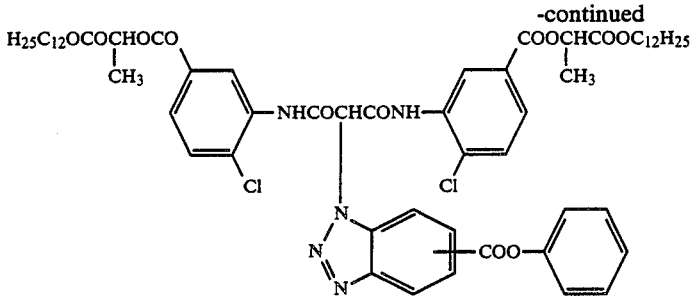

EX-6

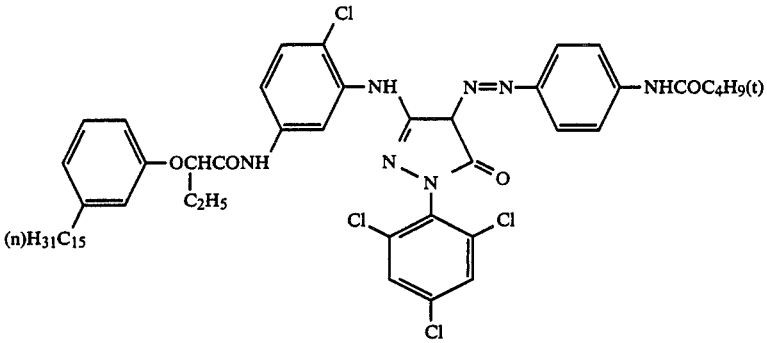

EX-7

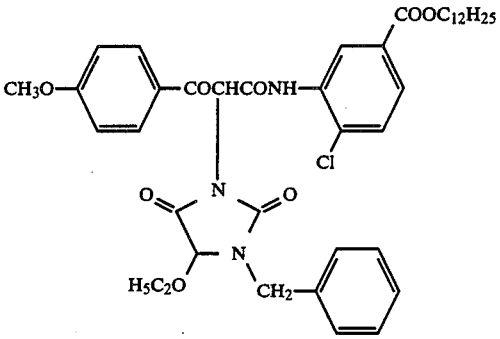

EX-9

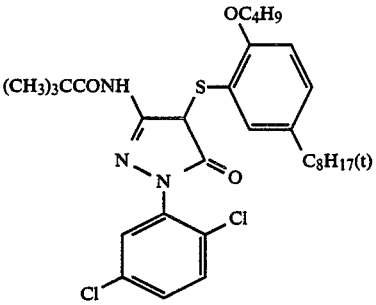

EX-10

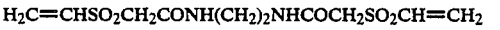

H-1

The photographic materials thus prepared were exposed to tungsten light at 25 cms (the color temperature of which had been adjusted to 4800° K. through a filter), followed by color development at 38° C. as follows:

The amount of the fixing solution taken into the first water washing bath from the fixing bath was about 55 ml per one $m^2$ of the photographic material processed. Two water washing baths comprising the first and second (final) baths were used. Washing water was replenished to the second bath in the amount of 940 ml per $m^2$ of the photographic material and overflowed to the first bath.

| | |
|---|---|
| Color development | 3 min. 15 sec. |
| Bleaching | 4 min. 20 sec. |
| Fixing | 4 min. 20 sec. |
| Water washing | 3 min. 15 sec. |
| Stabilizing | 30 sec. |

The composition of each of the processing solutions used in the steps described above was as follows:

| Color developing solution | |
|---|---|
| Trisodium nitrilotriacetate | 1.9 g |
| Sodium sulfite | 4.0 g |
| Potassium carbonate | 30.0 g |

-continued

| | |
|---|---|
| Potassium bromide | 1.4 g |
| Potassium iodide | 1.3 mg |
| Hydroxylamine sulfate | 2.4 g |
| 4-(N—ethyl-N—beta-hydroxyethylamino)-2-methylaniline sulfate | 4.5 g |
| Water to 1.0 liter | pH 10.0 |
| **Bleaching solution** | |
| Ethylenediaminetetraacetic acid, ferric ammonium salt | 100.0 g |
| Ethylenediaminetatraacetic acid, disodium salt | 8.0 g |
| Ammonium bromide | 150.0 g |
| Water to 1.0 liter | pH 6.0 |
| **Fixing solution** | |
| Sodium tetrapolyphosphate | 2.0 g |
| Sodium sulfite | 4.0 g |
| Aqueous ammonium thiosulfate solution (70%) | 175.0 ml |
| Sodium bisulfite | 4.6 g |
| Water to 1.0 liter | pH 6.6 |
| **Water washing solution** | |
| Ethylenediaminetetraacetic acid, tetrasodium salt | 200 mg |
| Ammonium sulfanilate | 100 mg |
| 2,4,6-Trichlorophenol | 50 mg |
| Water to 1.0 liter | |

-continued

| | |
|---|---|
| **Final stabilizing solution** | |
| Formalin (40%) | 8.0 ml |
| Polyoxyethylene-p-monononylphenylether (average degree of polymerization ≈ 10) | 0.3 g |
| Water to 1.0 liter | |

Each of the samples thus processed was divided into two pieces, one of which was kept at 80° C. for 12 days, and the other of which was kept at 40° C., 90% RH for 4 weeks. Difference between the photographic characteristics ($\Delta D_G$) of the materials just after processing and those of the stored materials was measured and is summarized in Table 1.

In Table 1, $\Delta D_G$ min stands for said difference at the minimum, magenta color density of the photographic material and $\Delta D_G$ 1.5 stands for said difference at the magenta color density of 1.5.

A minus sign (−) means that density decreases with time, while a plus sign (+) means that the density increases with time. The nearer to zero this value, i.e., the smaller the difference in density before and after storage, the better the storage property of color image.

TABLE 1

| | | | Storage property of color image | | | |
|---|---|---|---|---|---|---|
| | | | 80° C., 12 days | | 40° C./90% RH, 4 weeks | |
| Sample | Magenta coupler | | ΔDG min | ΔDG 1.5 | ΔDG min | ΔDG 1.5 |
| 1 | M-6 | This invention | ±0 | −0.01 | ±0 | −0.01 |
| 2 | M-7 | This invention | ±0 | −0.01 | ±0 | −0.01 |
| 3 | M-28 | This invention | ±0 | −0.03 | ±0 | −0.02 |
| 4 | M-25 | This invention | ±0 | −0.03 | ±0 | −0.02 |
| 5 | M-23 | This invention | −0.01 | −0.05 | −0.01 | −0.04 |
| 6 | M-30 | This invention | −0.02 | −0.06 | −0.01 | −0.03 |
| 7 | M-33 | This invention | −0.02 | −0.05 | −0.02 | −0.03 |
| 8 | m-31 | This invention | ±0 | ±0 | ±0 | ±0 |
| 9 | m-9 | This invention | ±0 | −0.02 | ±0 | −0.01 |
| 10 | m-18 | This invention | +0.02 | −0.04 | −0.02 | −0.03 |
| 11 | m-20 | This invention | +0.02 | −0.03 | −0.02 | −0.04 |
| 12 | m-36 | This invention | +0.02 | −0.04 | −0.02 | −0.04 |
| 13 | m-38 | This invention | +0.02 | −0.02 | −0.02 | −0.02 |
| 14 | m-41 | This invention | +0.01 | −0.04 | ±0 | −0.01 |
| 15 | 4-eq. coupler of M-6 | Comparative example | −0.05 | −0.15 | −0.04 | −0.10 |
| 16 | 4-eq. coupler of M-7 | Comparative example | −0.06 | −0.14 | −0.05 | −0.12 |
| 17 | 4-eq. coupler of M-28 | Comparative example | −0.05 | −0.12 | −0.05 | −0.10 |
| 18 | 4-eq. coupler of M-25 | Comparative example | −0.07 | −0.17 | −0.05 | −0.14 |
| 19 | 4-eq. coupler of M-23 | Comparative example | −0.08 | −0.19 | −0.06 | −0.13 |
| 20 | 4-eq. coupler of M-30 | Comparative example | −0.07 | −0.18 | −0.06 | −0.11 |
| 21 | 4-eq. coupler of M-33 | Comparative example | −0.07 | −0.15 | −0.06 | −0.12 |
| 22 | 4-eq. coupler of m-31 | Comparative example | +0.05 | −0.12 | −0.05 | −0.10 |
| 23 | 4-eq. coupler of m-9 | Comparative example | +0.06 | −0.14 | −0.05 | −0.11 |
| 24 | 4-eq. coupler of m-18 | Comparative example | +0.06 | −0.15 | −0.07 | −0.10 |
| 25 | 4-eq. coupler of m-20 | Comparative | +0.06 | −0.16 | −0.06 | −0.13 |

TABLE 1-continued

| Sample | Magenta coupler | | Storage property of color image 80° C., 12 days ΔDG min | ΔDG 1.5 | 40° C./90% RH, 4 weeks ΔDG min | ΔDG 1.5 |
|---|---|---|---|---|---|---|
| | | example | | | | |
| 26 | 4-eq. coupler of m-36 | Comparative example | +0.06 | −0.13 | −0.07 | −0.13 |
| 27 | 4-eq. coupler of m-38 | Comparative example | +0.05 | −0.13 | −0.06 | −0.11 |
| 28 | 4-eq. coupler of m-41 | Comparative example | +0.06 | −0.15 | −0.05 | −0.13 |

Table 1 shows that the photographic materials processed by this invention exhibited only a small change in color density after being kept under conditions of high temperature and/or high humidity and therefore that they are excellent in storage property of color image. Particularly, the photographic material containing magenta coupler m-31 (sample No. 8) showed almost no change in color density.

EXAMPLE 2

The emulsion layers and auxiliary layers were provided on a triacetylcellulose support on which an undercoat layer had been provided, to prepare photographic materials.

1st layer: Low speed red-sensitive emulsion layer

The cyan coupler, 2-(heptafluorobutylamido)-5-{2'-(2",4"-di-t-acylphenoxy)butylamido}-phenol (100 g), was dissolved in tricresylphosphate (100 cc) and ethyl acetate (100 cc). The solution was mixed with 10% gelatin solution in water (1 kg) and stirred to prepare an emulsion. The emulsion (500 g) was mixed with 1 kg of a low speed red-sensitive silver bromoiodide emulsion containing 70 g of silver, 60 g of gelatin and 3 mole % of silver iodide and then coated on the support so as to prepare a 2 micron thick dry film (the amount of silver coated: 0.5 g/m$^2$).

2nd layer: High speed red-sensitive emulsion layer

The cyan coupler, 2-(heptafluorobutylamido)-5-{2'-(2",4"-di-t-acylphenoxy)butylamido}-phenol (100 g), was dissolved in tricresylphosphate (100 cc) and ethylacetate (100 cc). The solution was mixed with 10% gelatin solution in water (1 kg) and stirred to prepare an emulsion. The emulsion (1000 g) was mixed with 1 kg of a high speed red-sensitive silver bromoiodide emulsion containing 70 g of silver, 60 g of gelatin and 3 mole % of silver iodide) and then coated so as to prepare a 2 micron thick dry film (The amount of silver coated: 0.8 g/m$^2$).

3rd layer: Interlayer 2.5-Di-t-octylhydroquinone was dissolved in dibutylphthalate (100 cc) and ethyl acetate (100 cc). The solution was mixed with 1 kg of 10% gelatin solution in water and stirred to prepare an emulsion. The emulsion (1 kg) was mixed with 1 kg of 10% gelatin solution in water and coated so as to make a 1 micron thick dry film. 2,5-Di-t-octylhydroquinone was used in the amount of 40 mg/m$^2$.

4th layer: Low speed green-sensitive emulsion layer

An emulsion was prepared by the same procedures as in the first layer except that the cyan coupler was replaced by the magenta coupler as described in Table 2. The emulsion (500 g) was mixed with 1 kg of a low speed green-sensitive silver bromoiodide emulsion containing 70 g of silver, 60 g of gelatin and 2.5 mole % of silver iodide and coated so as to make a 2.0 micron thick dry film (the amount of silver coated: 0.7 g/m$^2$).

5th layer: High speed green-sensitive emulsion layer

An emulsion was prepared by the same procedures as in the first layer except that the cyan coupler was replaced by the magenta coupler as describved in Table 2. The emulsion (1 kg) was mixed with 1 kg of high speed green-sensitive silver bromoiodide emulsion containing 70 g of silver, 60 g of gelatin and 2.5 mole % of silver iodide and coated to make a 2 micron thick dry film (the amount of silver coated: 0.7 g/m$^2$).

6th layer: Interlayer

The same emulsion (1 kg) as used in the 3rd layer was mixed with 1 kg of 10% gelatin solution in water and coated so as to make a 1 micron thick dry film.

7th layer: Yellow filter layer

An emulsion containing yellow colloidal silver was coated so as to make a 1 micron thick dry film.

8th layer: Low speed blue-sensitive emulsion layer

An emulsion was prepared by the same procedures as used in the first layer except that the cyan coupler was replaced by the yellow coupler, alpha-(pivaloyl)-alpha-(1-benzyl-5-ethoxy-3-hydantoinyl)-2-chloro-5-dodecyloxycarbonylacetanilide. The emulsion (1 kg) was mixed with 1 kg of low speed blue-sensitive silver bromoiodide emulsion containing 70 g of silver, 60 g of gelatin and 2.5 mole % of silver iodide and coated so as to make a 2.0 micron thick dry film (The amount of silver coated: 0.6 g/m$^2$).

9th layer: High speed blue-sensitive emulsion layer

An emulsion was prepared by the same procedures as used in the first layer except that the cyan coupler was replaced by the yellow coupler, alpha-(pivaloyl)-alpha-(1-benzyl-5-ethoxy-3-hydantoinyl)-2-chloro-5-dodecyloxycarbonylacetanilide. The emulsion (1 kg) was mixed with 1 kg of a high speed blue-sensitive silver bromoiodide emulsion containing 70 g of silver, 60 g of gelatin and 2.5 mole % of silver iodide and coated so as to make a 2.0 micron thick dry film (The amount of silver coated: 1.0 g/m$^2$).

10th layer: Second protective layer

The same emulsion (1 kg) as used in the third layer was mixed with 1 kg of 10% gelatin solution in water and coated so as to make a 2 micron thick dry film.

11th layer: First protective layer

A 10% gelatin solution in water containing fine grain emulsion that was chemically sensitized (grain size: 0.15 micron, 1 mole % silver bromoiodide emulsion) was coated so as to make a 1 micron thick dry film (The amount of silver coated: 0.3 g/m$^2$).

The color reversal films thus prepared were exposed to tungsten light, the color temperature of which had been adjusted to 4800° K. through a filter, at an appropriate exposure value, followed by color development according to the following steps. The amount of the fixing solution taken into the stabilizing bath from the fixing bath was about 80 ml per one m$^2$ of the photographic material to be processed. The stabilizing step used two stabilizing baths, i.e. first and second (final) baths which were countercurrently arranged. The stabilizing solution was replenished to the second stabilizing bath in the amount of 800 ml per $m^2$ of the photographic material to be processed.

| | | |
|---|---|---|
| First development bath | 6 min. | 38° C. |
| Water washing | 2 min. | " |
| Reversal bath | 2 min. | " |
| Color development bath | 6 min. | " |
| Conditioning bath | 2 min. | " |
| Bleaching bath | 6 min. | " |
| Fixing bath | 4 min. | " |
| Stabilizing bath | 4 min. | " |
| Final stabilizing bath | 1 min. | Room temperature |

First development bath

| | |
|---|---|
| Water | 700 ml |
| Sodium tetrapolyphosphate | 2 g |
| Sodium sulfite | 20 g |
| Hydroquinone monosulfonate | 30 g |
| Sodium carbonate (monohydrate) | 30 g |
| 1-phenyl-4-methyl-4-hydroxymethyl-3-pyrazolidone | 2 g |
| Potassium bromide | 2.5 g |
| Potassium thiocyanate | 1.2 g |
| Potassium iodide (0.1% solution) | 2 ml |
| Water to | 1000 ml |
| pH | 10.1 |

Reversal bath

| | |
|---|---|
| Water | 700 ml |
| Nitrilo-N,N,N—trimethylenephosphonic acid, pentasodium salt | 3 g |
| Stannous chloride (dihydrate) | 1 g |
| p-Aminophenol | 0.1 g |
| Sodium hydroxide | 8 g |
| Glacial acetic acid | 15 ml |
| Water to | 1000 ml |

Color development bath

| | |
|---|---|
| Water | 700 ml |
| Sodium tetrapolyphosphate | 2 g |
| Sodium sulfite | 7 g |
| Trisodium phosphate (dodecahydrate) | 36 g |
| Potassium bromide | 1 g |
| Potassium iodide (0.1% solution) | 90 ml |
| Sodium hydroxide | 3 g |
| Citrazinic acid | 1.5 g |
| N—Ethyl-N—beta-methanesulonamidoethyl-3-methyl-4-aminoaniline sesquisulfate monohydrate | 11 g |
| Ethylene diamine | 3 g |
| Water to | 1000 ml |

Conditioning bath

-continued

| | |
|---|---|
| Water | 700 ml |
| Sodium sulfite | 12 g |
| Ethylenediaminetetraacetic acid, sodium salt (dihydrate) | 8 g |
| Thioglycerine | 0.4 ml |
| Glacial acetic acid | 3 ml |
| Water to | 1000 ml |

Bleaching bath

| | |
|---|---|
| Water | 800 ml |
| Ethylenediaminetetraacetic acid, sodium salt (dihydrate) | 2.0 g |
| Ethylenediaminetetraacetic acid, iron (III) ammonium salt (dihydrate) | 120.0 g |
| Potassium bromide | 100.0 g |
| Water to | 1000 ml |

Fixing bath

| | |
|---|---|
| Water | 800 ml |
| Ammonium thiosulfate | 80.0 g |
| Sodium sulfite | 5.0 g |
| Sodium bisulfite | 5.0 g |
| Water to | 1000 ml |

Stabilizing bath

| | |
|---|---|
| Water | 800 ml |
| 5-Chloro-2-methyl-4-isothiazoline-3-one | 200 ml |
| 2-(4-Thiazolyl)benzimidazole | 20 mg |
| Glacial acetic acid | 2.0 ml |
| Adjusted to pH 4.5 by ammonium hydroxide and hydrogen chloride and water added to 1000 ml. | |

Final stabilizing bath

| | |
|---|---|
| Water | 800 ml |
| Formalin (37 wt %) | 5.0 ml |
| Polyoxyethylene paramononylphenyl ether | 5.0 ml |
| Water to | 1000 ml |

Each of the samples thus processed was divided into two pieces, one of which was kept at 80° C. for 9 days, and the other of which was kept at 40° C., 90% RH for 4 weeks. Difference between the photographic characteristics ($\Delta D_G$ min, $\Delta D_G$) of the material just after processing and those of the stored materials was measured and is summarized in Table 2.

In Table 2, $\Delta D_G$ min stands for said difference at the minimum magenta color density of photographic material and $\Delta D_G$ 1.5 stands for said difference at the magenta color density of 1.5. A minus sign (−) means that the density decreases with time, while a plus sign (+) means that the density increases with time. The nearer to zero this value, i.e., the smaller the difference in density before and after storage, the better the storage property of color image.

TABLE 2

| | | | Storage property of color image | | | |
|---|---|---|---|---|---|---|
| | | | 80° C. 9 days | | 40° C./90% RH, 4 weeks | |
| Sample | Magenta coupler | | ΔDG min | ΔDG 1.5 | ΔBG min | ΔDG 1.5 |
| 1 | M-5 | This invention | ±0 | −0.01 | ±0 | −0.01 |
| 2 | M-6 | This invention | ±0 | −0.01 | ±0 | −0.01 |
| 3 | M-28 | This invention | ±0 | −0.02 | ±0 | −0.02 |
| 4 | M-25 | This invention | ±0 | −0.02 | ±0 | −0.02 |
| 5 | M-23 | This invention | −0.01 | −0.04 | −0.02 | −0.05 |
| 6 | M-29 | This invention | −0.01 | −0.04 | −0.01 | −0.05 |
| 7 | M-35 | This invention | −0.02 | −0.05 | −0.02 | −0.05 |
| 8 | m-31 | This invention | ±0 | ±0 | ±0 | ±0 |
| 9 | m-9 | This invention | ±0 | −0.02 | ±0 | −0.01 |
| 10 | m-18 | This invention | +0.01 | −0.03 | −0.02 | −0.06 |

TABLE 2-continued

| Sample | Magenta coupler | | Storage property of color image 80° C. 9 days ΔDG min | ΔDG 1.5 | 40° C./90% RH, 4 weeks ΔBG min | ΔDG 1.5 |
|---|---|---|---|---|---|---|
| 11 | m-20 | This invention | +0.01 | −0.02 | −0.01 | −0.06 |
| 12 | m-36 | This invention | +0.01 | −0.03 | −0.02 | −0.05 |
| 13 | 4 eq. coupler of M-5 | Comparative example | −0.05 | −0.12 | −0.06 | −0.15 |
| 14 | 4 eq. coupler of M-6 | Comparative example | −0.05 | −0.14 | −0.07 | −0.15 |
| 15 | 4 eq. coupler of M-28 | Comparative example | −0.06 | −0.14 | −0.06 | −0.17 |
| 16 | 4 eq. coupler of M-25 | Comparative example | −0.07 | −0.15 | −0.07 | −0.18 |
| 17 | 4 eq. coupler of M-23 | Comparative example | −0.07 | −0.12 | −0.05 | −0.17 |
| 18 | 4 eq. coupler of M-29 | Comparative example | −0.07 | −0.12 | −0.06 | −0.16 |
| 19 | 4 eq. coupler of M-35 | Comparative example | −0.06 | −0.15 | −0.05 | −0.14 |
| 20 | 4 eq. coupler of m-31 | Comparative example | +0.05 | −0.12 | −0.05 | −0.14 |
| 21 | 4 eq. coupler of m-9 | Comparative example | +0.07 | −0.14 | −0060 | −0.15 |
| 22 | 4 eq. coupler of m-18 | Comparative example | +0.07 | −0.14 | −0.06 | −0.18 |
| 23 | 4 eq. coupler of m-20 | Comparative example | +0.06 | −0.12 | −0.07 | −0.17 |
| 24 | 4 eq. coupler of m-36 | Comparative example | +0.08 | −0.13 | −0.05 | −0.16 |

Table 2 shows that the photographic materials processed by this invention exhibited only a small change in color density after they were kept under conditions of high temperature and/or high humidity and therefore that they are excellent in storage property of color image. Particularly, the photographic material containing magenta coupler M-31 (Sample No. 8) showed almost no change in color density.

EXAMPLE 3

The same procedures as used in Example 1 were repeated except that the processing steps and the washing water were changed as follows. The photographic materials processed by this invention showed good storage property of color image.

| Processing steps | |
|---|---|
| Color development | 3 min. 15 sec. |
| Bleaching | 4 min. 20 sec. |
| Fixing | 4 min. 20 sec. |
| Water washing | 3 min. 15 sec. |
| Water washing solution | |
| Ethylenediaminetetraacetic acid tetrasodium salt | 200 mg |
| Sulfanylamide | 100 mg |
| p-Chloro-m-xylenol | 50 mg |
| Polyoxyethylene-p-monononyl-phenylether (average degree of polymerization ≈ 10) | 300 mg |
| Water to | 1000 ml |

What we claim is:

1. A method for processing a silver halide color photographic material for photography, which comprises a fixing or bleach-fixing step, followed by water washing or stabilizing step, characterized in that:

(i) said water washing or stabilizing step comprises multistage countercurrent baths which are countercurrently replenished with a washing water or stabilizing solution, (ii) the amount of the replenishing material is 3 to 50 times the volume of the solution taken by the photographic material into said water washing or stabilizing bath from the preceding bath, and (iii) said photographic material comprises at least one 2-equivalent magenta coupler selected from couplers (I-a) and (I-b), wherein:

said coupler (I-a) is represented by formula (I):

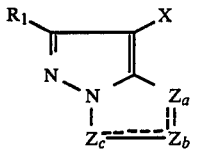

(I)

wherein $R_1$ represents a hydrogen atom or a substituent, X represents a group which can be split off by a coupling reaction with the oxidation products of an aromatic primary amine developing agent, Za, Zb and Zc represent individually methine, substituted methine, =N— or —NH—, one of the Za-Za and Zb-Zc linkages is a double bond and the other is a single bond, the Zb-Zc linkage, if it represents carbon-carbon double bond, may be part of aromatic ring, said coupler (I-b) comprises two or more moieties which are derived by removing $R_1$, Xc, or a substituent on substituted methine Za, Zb or Zc from the formula (I) and which are linked to each other.

2. The method of claim 1, wherein said photographic material comprises at least one blue-sensitive emulsion layer, at least one green-sensitive emulsion layer and at least one red-sensitive emulsion layer and said 2-equivalent magenta coupler is incorporated in said green-sensitive layer.

3. The method of claim 1, wherein the emulsion used in said photographic material is a negative type silver halide emulsion.

4. The method of claim 3, wherein said negative type silver halide emulsion comprises silver bromoiodide.

5. The method of claim 4, wherein said silver bromoiodide contains 2 to 15 mole % of silver iodide.

6. The method of claim 1, wherein said photographic material is a color negative film or color reversal film.

7. The method of claim 1, wherein the amount of silver incorporated in said photographic material is 5 to 15 g/m$^2$.

8. The method of claim 1, wherein said 2-equivalent magenta coupler is said coupler (I-a).

9. The method of claim 1, wherein said 2-equivalent magenta coupler is said coupler (I-b).

10. The method of claim 8, wherein said coupler (I-a) is selected from couplers represented by the formula (I)-2, (I)-3, (I)-4, (I)-5, (I)-6 or (I)-7:

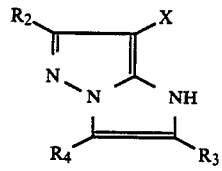
[I]-2

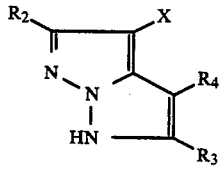
[I]-3

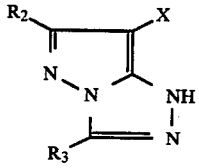
[I]-4

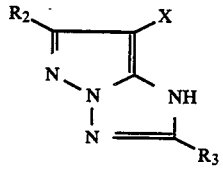
[I]-5

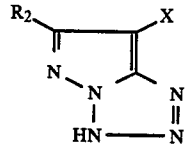
[I]-6

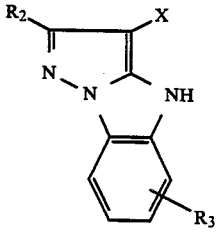
[I]-7 wherein $R_2$, $R_3$ and $R_4$ represent individually hydrogen or halogen atom, alkyl, aryl, heteroring, cyano, heteroring-oxy, acyloxy, carbamoyloxy, silyloxy, sulfonyloxy, acylamino, anilino, ureido, imido, sulfamoylamino, carbamoylamino, alkylthio, arylthio, heteroring-thio, alkoxycarbonylamino, aryloxycarbonylamino, sulfonamido, carbamoyl, acyl, sulfamoyl, sulfonyl, sulfinyl, alkoxycarbonyl or aryloxycarbonyl group, X represents halogen atom, carboxy group of a coupling split-off group which is attached to carbon atom at the coupling position through oxygen, nitrogen or sulfur atom.

11. The method of claim 10, wherein said coupler (I-a) is selected from couplers represented by the formula (I)-2, (I)-4 or (I)-5.

12. The method of claim 9, wherein said coupler (I-b) is selected from couplers which comprise two or more residues which are obtained by removing $R_2$, $R_3$, $R_4$ or X from the formula (I)-2, (I)-3, (I)-4, (I)-5, (I)-6 or (I)-7 and which are linked to each other.

13. The method of claim 12, wherein said coupler (I)-b is selected from couplers which comprises two or more residues which are obtained by removing $R_2$, $R_3$, $R_4$ or X from the formula (I)-2, (I)-4 or (I)-5 and which are linked to each other.

14. The method of claim 8, wherein X is a nitrogen-containing 5- or 6-membered heteroring or imido group.

15. The method of claim 9, wherein X is a nitrogen-containing 5- or 6-membered heteroring or imido group.

16. The method of claim 1, wherein said 2-equivalent magenta coupler is incorporated in an amount of $2\times10^{-3}$ to $5\times10^{-1}$ mole per mole of silver.

17. The method of claim 1, which comprises the steps of color development—bleaching—fixing or bleach-fixing—water washing or stabilizing.

18. The method of claim 1, wherein said water washing or stabilizing step comprise 2 to 9 stage countercurrent baths.

19. The method of claim 1, wherein the amount of the replenishing material is 3 to 40 times the volume of the solution taken into the washing or stabilizing bath from the preceding bath.

20. The method of claim 1, wherein the washing water or stabilizing solution contains an antimold agent or bactericide.

21. The method of claim 1, wherein the washing water or stabilizing solution contains a chelating agent.

22. The method of claim 1, wherein the bleaching agent contained in said bleaching or bleach-fixing solution is selected from ethylenediaminetetraacetic acid iron (III) complex salts and diethylenetriaminepentaacetic acid iron (III) complex salts.

23. A method for processing a silver halide color photographic material for photography, which comprises a fixing or bleach-fixing step, followed by water washing or stabilizing step, characterized in that:

(i) said water washing or stabilizing step comprises multistage countercurrent baths which are countercurrently replenished with a washing water or stabilizing solution, (ii) the amount of the replenishing material is 3 to 50 times the volume of the solution taken by the photographic material into said water washing or stabilizing bath from the preceding bath, and (iii) said photographic material comprises at least one 2-equivalent magenta coupler selected from couplers (II-a) and (II-b), wherein:

said coupler (II-a) is represented by formula (II):

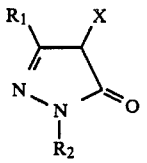

(II)

wherein $R_1$ represents a carbonamide, anilino or ureido group, $R_2$ represents a phenyl group and X represents an azole group which can be split off by a coupling reaction with the oxidation products of an aromatic primary amine developing agent; and said coupler (II-b) comprises two or more moieties which are derived by removing $R_1$, $R_2$ or X from the formula (II) and which are linked to each other.

24. The method of claim 23, wherein said photographic material comprises at least one blue-sensitive emulsion layer, at least one green-sensitive emulsion layer and at least one red-sensitive emulsion layer and said 2-equivalent magenta coupler is incorporated in said green-sensitive layer.

25. The method of claim 23, wherein the emulsion used in said photographic material is a negative type silver halide emulsion.

26. The method of claim 25, wherein said negative type silver halide emulsion comprises silver bromoiodide.

27. The method of claim 26, wherein said silver bromoiodide contains 2 to 15 mole % of silver iodide.

28. The method of claim 23, wherein said photographic material is a color negative film or color reversal film.

29. The method of claim 23, wherein the amount of silver incorporated in said photographic material is 5 to 15 g/m$^2$.

30. The method of claim 23, wherein said 2-equivalent magenta coupler is said coupler (II-a).

31. The method of claim 23, wherein said 2-equivalent magenta coupler is said coupler (II-b).

32. The method of claim 30, wherein X is a nitrogen-containing 5- or 6-membered heteroring or imido group.

33. The method of claim 31, wherein X is a nitrogen-containing 5- or 6-membered heteroring or imido group.

34. The method of claim 23, wherein said 2-equivalent magenta coupler is incorporated in an amount of $2\times10^{-3}$ to $5\times10^{-1}$ mole per mole of silver.

35. The method of claim 23, which comprises the steps of color development—bleaching—fixing or bleach-fixing—water washing or stabilizing.

36. The method of claim 23, wherein said water washing or stabilizing step comprise 2 to 9 stage countercurrent baths.

37. The method of claim 23, wherein the amount of the replenishing material is 3 to 40 times the volume of the solution taken into the washing or stabilizing bath from the preceding bath.

38. The method of claim 23, wherein the washing water or stabilizing solution contains an antimold agent or bactericide.

39. The method of claim 23, wherein the washing water or stabilizing solution contains a chelating agent.

40. The method of claim 23, wherein the bleaching agent contained in said bleaching or bleach-fixing solution is selected from ethylenediaminetetraacetic acid iron (III) complex salts and diethylenetriaminepentaacetic acid iron (III) complex salts.

41. A method for processing a silver halide color photographic material for photography, which comprises a fixing or bleach-fixing step, followed by water washing or stabilizing step, characterized in that:

(i) said water washing or stabilizing step comprises multistage countercurrent baths which are countercurrently replenished with a washing water or stabilizing solution, (ii) the amount of the replenishing material is 3 to 50 times the volume of the solution taken by the photographic material into said water washing or stabilizing bath from the preceding bath, and (iii) said photographic material comprises at least one 2-equivalent magenta coupler selected from couplers (I-a), (I-b), (II-a) and (II-b), wherein:

said coupler (I-a) is represented by formula (I):

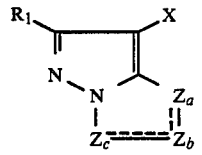

(I)

wherein $R_1$ represents a hydrogen atom or a substituent, X represents a group which can be split off by a coupling reaction with the oxidation products of an aromatic primary amine developing agent, Za, Zb and Zc represent individually methine, substituted methine, =N— or —NH—, one of the Za-Za and Zb-Zc linkages is a double bond and the other is a single bond, the Zb-Zc linkage, if it represents carbon-carbon double bond, may be part of aromatic ring, said coupler (I-b) comprises two or more moieties which are derived by removing $R_1$, Xc, or a substituent on substituted methine Za, Zb or Zc from the formula (I) and which are linked to each other, said coupler (II-a) is represented by the formula (II):

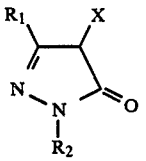

(II)

wherein $R_1$ represents a carbonamide, anilino or ureido group, $R_2$ represents a phenyl group and X represents a group which can be split off by a coupling reaction with the oxidation products of an aromatic primary amine developing agent, and said coupler (II-b) comprises two or more moieties which are derived by removing $R_1$, $R_2$ or X from the formula (II) and which are linked to each other, and (vi) said water washing or stabilizing solution contains at least one compound selected from the group consisting of isothiazolone compounds, halogenated phenolic compounds and sulfamine agents.

42. The method of claim 41, wherein said halogenated phenolic compound is parachloro-metaxylenol or 2,4,6-trichlorophenol.

43. The method of claim 41, wherein said photographic material comprises at least one blue-sensitive emulsion layer, at least one green-sensitive emulsion layer and at least one red-sensitive emulsion layer and said 2-equivalent magenta coupler is incorporated in said green-sensitive layer.

44. The method of claim 41, wherein the emulsion used in said photographic material is a negative type silver halide emulsion.

45. The method of claim 44, wherein said negative type silver halide emulsion comprises silver bromoiodide.

46. The method of claim 45, wherein said silver bromoiodide contains 2 to 15 mole % of silver iodide.

47. The method of claim 41, wherein said photographic material is a color negative film or color reversal film.

48. The method of claim 41, wherein the amount of silver incorporated in said photographic material is 5 to 15 g/m$^2$.

49. The method of claim 41, wherein said 2-equivalent magenta coupler is said coupler (I-a).

50. The method of claim 41, wherein said 2-equivalent magenta coupler is said coupler (I-b).

51. The method of claim 41, wherein said 2-equivalent magenta coupler is said coupler (II-a).

52. The method of claim 41, wherein said 2-equivalent magenta coupler is said coupler (II-b).

53. The method of claim 49, wherein said coupler (I-a) is selected from couplers represented by the formula (I)-2, (I)-3, (I)-4, (I)-5, (I)-6 or (I)-7:

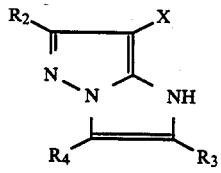
[I]-2

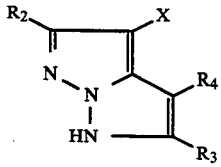
[I]-3

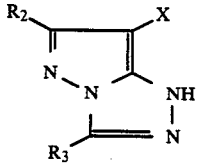
[I]-4

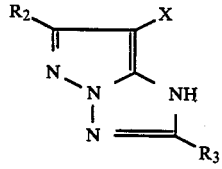
[I]-5

-continued

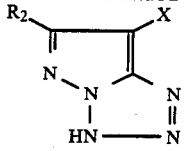
[I]-6

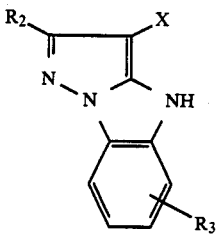
[I]-7 wherein $R_2$, $R_3$ and $R_4$ represent individually hydrogen or halogen atom, alkyl, aryl, heteroring, cyano, heteroring-oxy, acyloxy, carbamoyloxy, silyloxy, sulfonyloxy, acylamino, anilino, ureido, imido, sulfamoylamino, carbamoylamino, alkylthio, arylthio, heteroring-thio, alkoxycarbonylamino, aryloxycarbonylamino, sulfonamido, carbamoyl, acyl, sulfamoyl, sulfonyl, sulfinyl, alkoxycarbonyl or aryloxycarbonyl group, X represents halogen atom, carboxy group of a coupling split-off group which is attached to carbon atom at the coupling position through oxygen, nitrogen or sulfur atom.

54. The method of claim 53, wherein said coupler (I-a) is selected from couplers represented by the formula (I)-2, (I)-4 or (I)-5.

55. The method of claim 50, wherein said coupler (I-b) is selected from couplers which comprise two or more residues which are obtained by removing $R_2$, $R_3$, $R_4$ or X from the formula (I)-2, (I)-3, (I)-4, (I)-5, (I)-6 or (I)-7 and which are linked to each other.

56. The method of claim 55, wherein said coupler (I)-b is selected from couplers which comprises two or more residues which are obtained by removing $R_2$, $R_3$, $R_4$ or X from the formula (I)-2, (I)-4 or (I)-5 and which are linked to each other.

57. The method of claim 51, wherein X is a nitrogen-containing 5- or 6-membered heteroring or imido group.

58. The method of claim 52, wherein X is a nitrogen-containing 5- or 6-membered heteroring or imido group.

59. The method of claim 41, wherein said 2-equivalent magenta coupler is incorporated in an amount of $2\times10^{-3}$ to $5\times10^{-1}$ mole per mole of silver.

60. The method of claim 41, which comprises the steps of color development—bleaching—fixing or bleach-fixing—water washing or stabilizing.

61. The method of claim 41, wherein said water washing or stabilizing step comprise 2 to 9 stage countercurrent baths.

62. The method of claim 41, wherein the amount of the replenishing material is 3 to 40 times the volume of the solution taken into the washing or stabilizing bath from the preceding bath.

63. The method of claim 41, wherein the washing water or stabilizing solution contains an antimold agent or bactericide.

64. The method of claim 41, wherein the washing water or stabilizing solution contains a chelating agent.

65. The method of claim 41, wherein the bleaching agent contained in said bleaching or bleach-fixing solution is selected from ethylenediaminetetraacetic acid iron (III) complex salts and diethylenetriaminepentaacetic acid iron (III) complex salts.

* * * * *